US010215108B2

(12) United States Patent
Nakasaka

(10) Patent No.: US 10,215,108 B2
(45) Date of Patent: Feb. 26, 2019

(54) CONTROL DEVICE AND CONTROL METHOD OF INTERNAL COMBUSTION ENGINE

(71) Applicant: TOYOTA JIDOSHA KABUSHIKI KAISHA, Toyota-shi, Aichi-ken (JP)

(72) Inventor: Yukihiro Nakasaka, Suntou-gun (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/841,545

(22) Filed: Dec. 14, 2017

(65) Prior Publication Data

US 2018/0179964 A1 Jun. 28, 2018

(30) Foreign Application Priority Data

Dec. 22, 2016 (JP) ..... 2016-249871

(51) Int. Cl.

| | |
|---|---|
| ***F02D 15/02*** | (2006.01) |
| ***F02B 75/04*** | (2006.01) |
| ***F02D 15/04*** | (2006.01) |
| ***F02D 35/02*** | (2006.01) |
| ***F02D 41/04*** | (2006.01) |

(52) U.S. Cl.

CPC ..... *F02D 15/02* (2013.01); *F02B 75/041* (2013.01); *F02D 15/04* (2013.01); *F02D 35/023* (2013.01); *F02D 41/04* (2013.01); *F02D 2200/02* (2013.01)

(58) Field of Classification Search

CPC .... F02D 15/04; F02D 2041/001; F02D 15/00; F02D 2700/03; F02B 75/041; F02B 75/04

See application file for complete search history.

(56) References Cited

U.S. PATENT DOCUMENTS

2007/0250249 A1* 10/2007 Okubo ..... G01L 3/245 701/103
2008/0022982 A1* 1/2008 Kamiyama ..... F02B 69/02 123/575

(Continued)

FOREIGN PATENT DOCUMENTS

| | | |
|---|---|---|
| JP | 2004-183594 | 7/2004 |
| JP | 2010-185399 | 8/2010 |

*Primary Examiner* — Long T Tran

(74) *Attorney, Agent, or Firm* — Finnegan, Henderson, Farabow, Garrett & Dunner, LLP

(57) ABSTRACT

An internal combustion engine having a plurality of cylinders comprises a variable compression ratio mechanism A able to change a mechanical compression ratio. The control device comprises a compression ratio detector for detecting a mechanical compression ratio based on a value of the relative position parameter representing a relative positional relationship between the cylinder block 2 and a piston 4, and a compression ratio controller for feedback controlling the mechanical compression ratio so that the mechanical compression ratio becomes a target mechanical compression ratio. In feedback controlling the variable compression ratio mechanism, the compression ratio controller does not use the mechanical compression ratio detected by the compression ratio detector when a crank angle is in a predetermined crank angle range including a time period where the cylinder pressure is equal to or greater than a preset predetermined pressure at least at one cylinder among the plurality of cylinders.

10 Claims, 14 Drawing Sheets

(56) References Cited

U.S. PATENT DOCUMENTS

| | | | | |
|---|---|---|---|---|
| 2008/0087255 | A1* | 4/2008 | Aoyama | F02D 13/023 123/48 B |
| 2008/0190406 | A1* | 8/2008 | Akihisa | F02D 15/04 123/78 C |
| 2009/0132144 | A1* | 5/2009 | Shinozaki | F02D 15/02 701/102 |
| 2010/0107995 | A1* | 5/2010 | Kamiyama | F01P 7/14 123/41.02 |
| 2015/0136089 | A1* | 5/2015 | Tanaka | F02D 41/1446 123/48 R |
| 2015/0354488 | A1* | 12/2015 | Hiyoshi | F02D 41/123 123/48 B |

* cited by examiner

CONTROL DEVICE AND CONTROL METHOD OF INTERNAL COMBUSTION ENGINE

TECHNICAL FIELD

The present invention relates to a control device of an internal combustion engine and a control method of an internal combustion engine.

BACKGROUND ART

Known in the past has been an internal combustion engine comprising a variable compression ratio mechanism able to change a mechanical compression ratio of the internal combustion engine by changing a combustion chamber volume when a piston is at top dead center. As this variable compression ratio mechanism, a mechanism moving a cylinder block relative to a crankcase (for example, PLT 1) has been known.

In an internal combustion engine comprising this variable compression ratio mechanism, a target mechanical compression ratio is set based on an engine load, engine rotational speed, etc. The variable compression ratio mechanism is feedback controlled so as to reach this target mechanical compression ratio. In performing such control, it is necessary to detect a current mechanical compression ratio in the variable compression ratio mechanism. In the internal combustion engine described in PLT 1, a control shaft rotates to change the mechanical compression ratio, and the rotational angle of this control shaft is detected to detect the current mechanical compression ratio.

CITATION LIST

Patent Literature

PLT 1: Japanese Patent Publication. No. 2004-183594A

SUMMARY OF INVENTION

Technical Problem

In the above-mentioned variable compression ratio mechanism, if combustion of the air-fuel mixture causes the pressure inside the combustion chambers to greatly change, the detected value of the mechanical compression ratio changes accordingly. Such a change in the detected value of the mechanical compression ratio occurs, for example, due to torsion generated at the control shaft or deformation of the cylinder block accompanying a rise in the pressure inside the combustion chambers. Even if the detected value of the mechanical compression ratio changes along with torsion of the control shaft or deformation of the cylinder block in this way, the torsion of the control shaft or deformation of the cylinder block is eliminated together with a drop in the pressure in the combustion chambers, and as a result the detected value of the mechanical compression ratio returns to the original level.

In this regard, when performing feedback control so that the mechanical compression ratio becomes the target mechanical compression ratio, if the detected value of the mechanical compression ratio falls along with combustion of the air-fuel mixture, a variable compression ratio mechanism is driven so that the mechanical compression ratio becomes higher accordingly. However, after that, if the pressure in the combustion chambers falls, as explained above, the detected value of the mechanical compression ratio also returns to the original level. Therefore, if driving the variable compression ratio mechanism so that the mechanical compression ratio becomes higher along with a fall in the detected value of the mechanical compression ratio accompanying combustion of the air-fuel mixture, the variable compression ratio mechanism is wastefully driven.

The present invention was made in consideration of the above problem and has as its object to provide a control device of an internal combustion engine not wastefully driving a variable compression ratio mechanism even if a detected value of a mechanical compression ratio changes due to a pressure fluctuation in the combustion chambers accompanying combustion.

Solution to Problem

The present invention was made so as to solve the problem and has as its gist the following:

(1) A control device of an internal combustion engine controlling an internal combustion engine having a plurality of cylinders which comprises a variable compression ratio mechanism able to change a mechanical compression ratio by moving a cylinder block relative to a crankcase, the control device comprising: a compression ratio detector for detecting a mechanical compression ratio based on a value of a relative position parameter representing a relative positional relationship between the cylinder block and a piston with respect to a crank angle; and a compression ratio controller for feedback controlling the variable compression ratio mechanism so that the mechanical compression ratio detected by the compression ratio detector becomes a target mechanical compression ratio, wherein in feedback controlling the variable compression ratio mechanism, the compression ratio controller does not use the mechanical compression ratio detected by the compression ratio detector when a crank angle is in a predetermined crank angle range including a time period where the cylinder pressure is equal to or greater than a preset predetermined pressure at least at one cylinder where the fluctuation of the relative position parameter is greatest due to fluctuation of the cylinder pressure accompanying combustion.

(2) The control device of an internal combustion engine according to (1), wherein the compression ratio detector is configured to detect a relative position of the crankcase and the cylinder block to thereby detect the mechanical compression ratio.

(3) The control device of an internal combustion engine according to (1) or (2), wherein the predetermined crank angle range is a range of 0° ATDC to 30° ATDC based on compression top dead center of at least one cylinder.

(4) The control device of an internal combustion engine according to (1) or (2), wherein the predetermined crank angle range includes a time period where the cylinder pressure is equal to or greater than a preset predetermined pressure at all of the cylinders.

(5) The control device of an internal combustion engine according to (4), wherein the predetermined crank angle range is a range of 0° ATDC to 30° ATDC based on compression top dead center at each cylinder.

(6) The control device of an internal combustion engine according to any one of (1) to (5), wherein in feedback controlling the variable compression ratio mechanism, the compression ratio controller uses only the mechanical compression ratio detected by the compression ratio detector at a specific crank angle set outside the predetermined crank angle range.

(7) The control device of an internal combustion engine according to (6), wherein the specific crank angle is set at an every angle obtained by dividing 720° by the number of cylinders.

(8) The control device of an internal combustion engine according to (2) wherein the internal combustion engine has three or more cylinders arranged in one line, the compression ratio detector is arranged adjacent to a cylinder positioned at one end in a direction in which the cylinders are arranged in a row, and the predetermined crank angle range includes a time period when the cylinder pressure is equal to or greater than a preset predetermined pressure at the cylinder positioned at one end.

(9) The control device of an internal combustion engine according to any one of (1) to (8), wherein in feedback controlling the variable compression ratio mechanism, the compression ratio controller uses a mechanical compression ratio detected at a predetermined time interval regardless of the crank angle when an engine rotational speed is less than a predetermined reference rotational speed, which is lower than an idling speed.

(10) A control method for controlling an internal combustion engine having a plurality of cylinders which comprises a variable compression ratio mechanism able to change a mechanical compression ratio by moving a cylinder block relative to a crankcase, the control method comprising: detecting a mechanical compression ratio based on a value of a relative position parameter representing a relative positional relationship between the cylinder block and a piston with respect to a crank angle; and feedback controlling the variable compression ratio mechanism so that the detected mechanical compression ratio becomes a target mechanical compression ratio, wherein in feedback controlling the variable compression ratio mechanism, the detected mechanical compression ratio is not used when a crank angle is in a predetermined crank angle range including a time period where the cylinder pressure is equal to or greater than a preset predetermined pressure at least at one cylinder where the fluctuation of the relative position parameter is greatest due to fluctuation of the cylinder pressure accompanying combustion.

Advantageous Effects of Invention

According to the present invention, there is provided a control device of an internal combustion engine not wastefully driving a variable compression ratio mechanism even if a detected value of a mechanical compression ratio changes due to a pressure fluctuation in a combustion chamber accompanying combustion.

DESCRIPTION OF EMBODIMENTS

Figure 1:
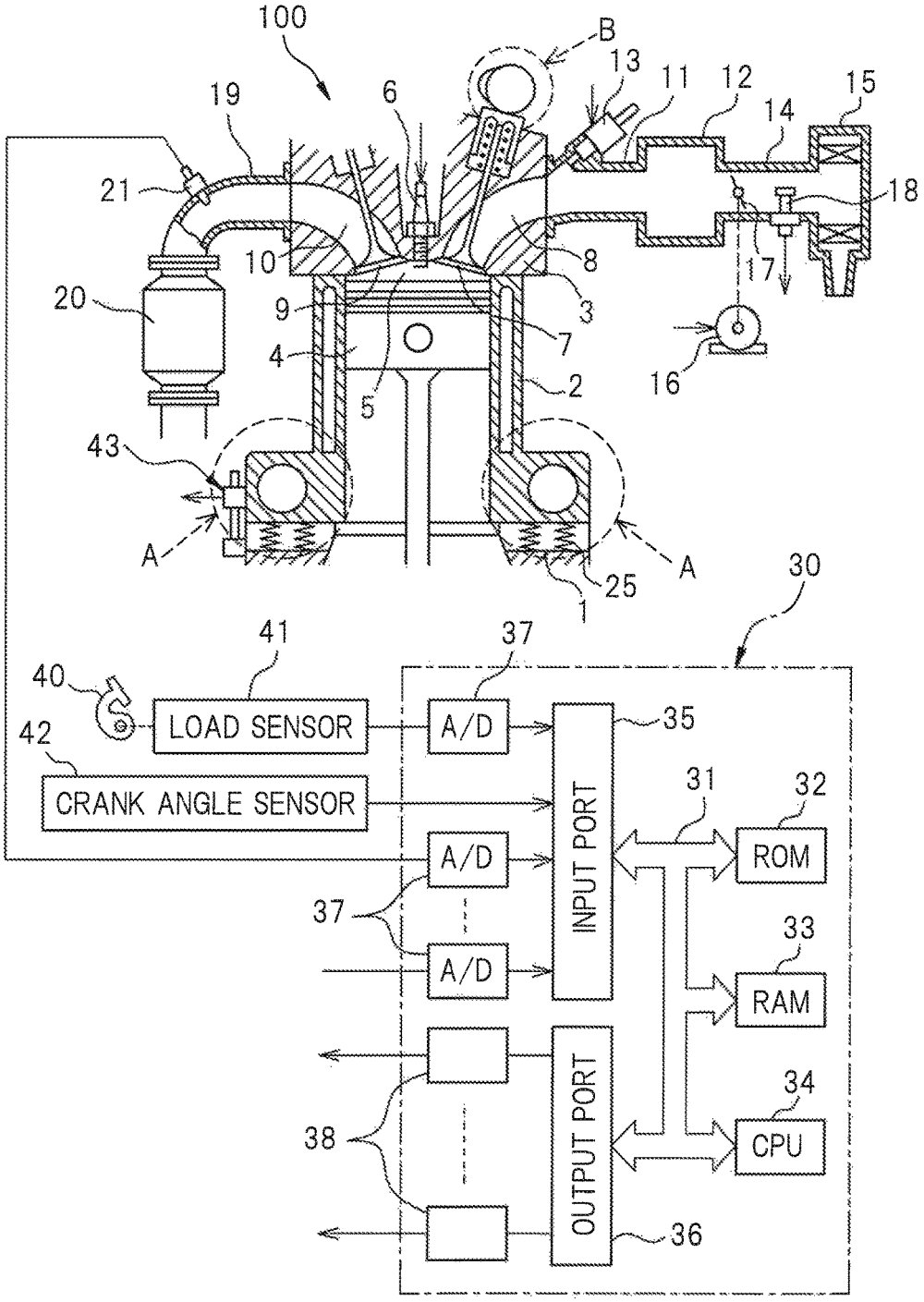
FIG. 1 schematically shows a side cross-sectional view of an internal combustion engine in which a control device according to one embodiment of the present invention is used.

Below, referring to the drawings, embodiments of the present invention will be explained in detail. Note that, in the following explanation, similar component elements will be assigned the same reference numerals.

First Embodiment

<<Configuration of Internal Combustion Engine>>

FIG. 1 schematically shows a side cross-sectional view of an internal combustion engine having a plurality of cylinders in which a control device according to a first embodiment of the present invention is used. If referring to FIG. 1, the engine body 100 of an internal combustion engine having a plurality of cylinders comprises a crankcase 1, cylinder block 2, cylinder head 3, pistons 4, combustion chambers 5, spark plugs 6 arranged at the centers of the top surfaces of the combustion chambers 5, intake valves 7, intake ports 9, exhaust valves 9, and exhaust ports 10. The intake ports 8 are connected through intake branch pipes 11 to a surge tank 12. At the intake branch pipes 11, fuel injectors 13 are arranged for injecting fuel toward the insides of the corresponding intake ports 8. Note that, the fuel injectors 13 may also be arranged inside the combustion chambers 5 instead of being attached to the intake branch pipes 11.

The surge tank 12 is connected through an intake duct 14 to an air cleaner 15. Inside the intake duct 14, a throttle valve 17 driven by an actuator 16 and an intake air flow detector (air flowmeter) 18 using for example a hot wire, are arranged. On the other hand, the exhaust ports 10 are connected through an exhaust manifold 19 to a catalytic converter 20 housing for example a three-way catalyst. An air-fuel ratio sensor 21 is arranged in the exhaust manifold 19.

On the other hand, in the embodiment shown in FIG. 1, at the connecting part between the crankcase 1 and cylinder block 2, a variable compression ratio mechanism A is provided, which is able to change the volumes of the combustion chambers 5 when the pistons 4 are at compression top dead center by changing the relative distance between the crankcase 1 and the cylinder block 2 in the cylinder axial direction. Further, between the crankcase 1 and cylinder block 2, springs 25 functioning as biasing members are arranged. The springs 25 are configured so as to bias the cylinder block 2 in a direction away from the crankcase 1. Furthermore, in the embodiment shown in FIG. 1, a variable valve timing mechanism B is provided, which is able to control at least one of an opening timing, closing timing, and lift of the intake valves 7.

An electronic control unit (ECU) 30 is a digital computer comprising components connected with each other through a bidirectional bus 31 such as a ROM (read only memory) 32, RAM (random access memory) 33, CPU (microprocessor) 34, input port 35, and output port 36. The output signal of the intake air flow detector 18 and the output signal of the air-fuel ratio sensor 21 are input through respectively corresponding AD converters 37 to the input port 35.

Further, the accelerator pedal 40 is connected to a load sensor 41 generating an output voltage proportional to the amount of depression of the accelerator pedal 40. The output voltage of the load sensor 41 is input through a corresponding AD converter 37 to an input port 35. Furthermore, the input port 35 is connected to a crank angle sensor 42 generating an output. pulse every time a crankshaft rotates by for example 15°. Furthermore, the cylinder block 2 comprises a relative distance sensor 43 for detecting a relative distance between the cylinder block 2 and the crankcase 1. The output voltage of the relative distance sensor 43 is input through a corresponding AD converter 37 to the input port 35. On the other hand, the output port 36 is connected through a corresponding drive circuit 38 to the spark plugs 6, the fuel injectors 13, the throttle valve drive actuator 16, a variable compression ratio mechanism A, and a variable valve timing mechanism B.

Note that, the ECU 30, together with the load sensor 41, crank angle sensor 42, and relative distance sensor 43, form a control device for controlling the internal combustion engine. The control device comprises a compression ratio detector for detecting a mechanical compression ratio and a compression ratio controller for controlling the variable compression ratio mechanism A. The compression ratio detector is mainly comprised of the ECU 30 and relative distance sensor 43, while the compression ratio controller is mainly comprised of the ECU 30, load sensor 41, and crank angle sensor 42.

<<Configuration of Variable Compression Ratio Mechanism>>

Figure 2:
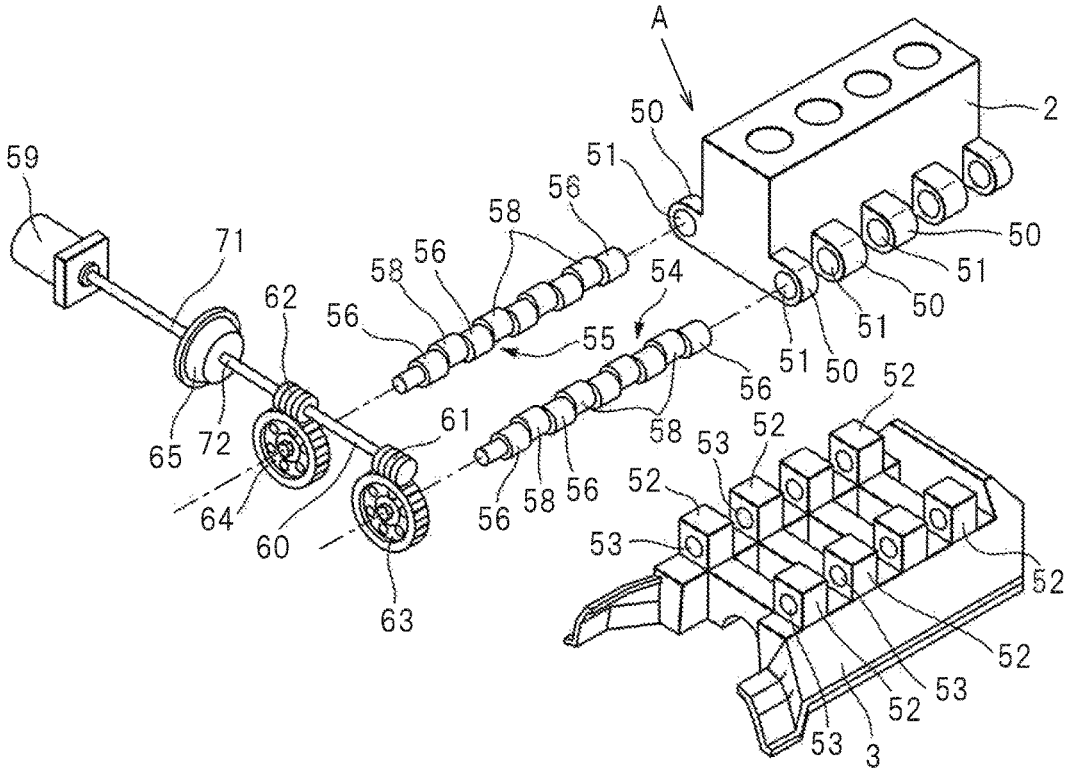
FIG. 2 is a disassembled perspective view of a variable compression ratio mechanism shown in FIG. 1.
Figure 3:
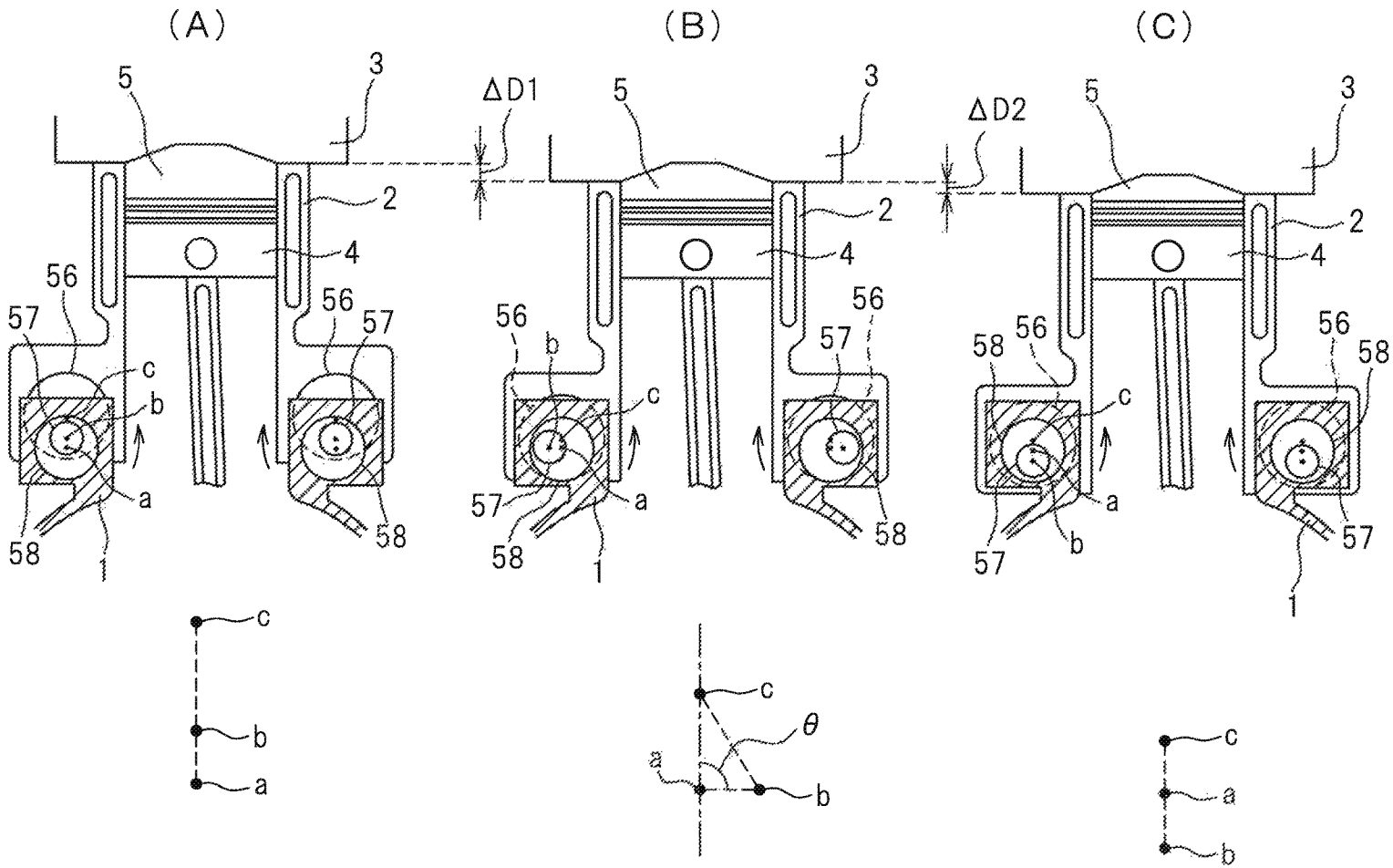
FIG. 3 shows a side cross-sectional view of an internal combustion engine illustrated schematically.

Next, the configuration of the variable compression ratio. mechanism A of the present embodiment will be explained with reference to FIGS. 2 and 3. FIG. 2 shows a. disassembled perspective view of the variable compression ratio mechanism A shown in FIG. 1, while FIG. 3 shows a side cross-sectional view of the schematically illustrated internal combustion engine.

The variable compression ratio mechanism A, as shown in FIG. 2, comprises pluralities of block side projections 50 formed at intervals from each other at the lower parts of the both side walls of the cylinder block 2. Circular cross-sectional block side cam insertion holes 51 are formed in the block side projections 50. These block side cam insertion holes 51 are formed on the same axes so as to become parallel in the direction of arrangement of the cylinders.

Further, the variable compression ratio mechanism A comprises pluralities of case side projections 52 formed at intervals from each other at the upper surface of the crankcase 1. The case side projections 52 fit between the respectively corresponding block side projections 50. Circular cross-sectional case side cam insertion holes 53 are also formed in the case side projections 52, respectively. These case side cam. insertion holes 53 are also formed on the same axes so as to become parallel in the direction of arrangement of the cylinders, in the same way as the block side cam. insertion holes 51.

In addition, as shown in FIG. 2, the variable compression ratio mechanism A comprises a pair of cam shafts 54 and 55 functioning as actuating shafts. On the cam shafts 54 and 55, case side circular cams 58 are fastened at every other position to be rotatably inserted into the case side cam insertion holes 53. These case side circular cams 58 are coxial with the axes of the cam shafts 54 and 55. On the other hand, at the both sides of each case side circular cam 58, as shown in FIG. 3, eccentric shafts 57 eccentrically arranged with respect to the axes of the cam shafts 54 and 55 extend. Block side circular cams 56 are eccentrically and rotatably attached on the eccentric shafts 57. As shown in FIG. 2, these block side circular cams 56 are arranged at both sides of the case side circular cams 58. These block side circular cams 56 are rotatably inserted in the corresponding block side cam insertion holes 51.

Furthermore, the variable compression ratio mechanism A comprises a drive motor (actuator) 59. As shown in FIG. 2, to make the cam shafts 54 and 55 rotate in opposite directions to each other, a pair of worm gears 61 and 62 with thread directions opposite in direction are attached to a shaft 60 of the drive motor (actuator) 59. Worm wheels 63 and 64 engaging with these worm gears 61 and 62 are fastened to the ends of the respective cam shafts 54 and 55. In the present embodiment, by driving the drive motor 59, it is possible to change the volume of the combustion chambers 5 when the pistons 4 are positioned at compression top dead center over a broad range. Accordingly, it is possible to change the mechanical compression ratio of the internal combustion engine over a broad range.

<<Method of Changing Mechanical Compression Ration by Variable Compression Ratio Mechanism>>

Next, the method of changing the mechanical compression ratio by the variable compression ratio mechanism A of the above-mentioned configuration will be explained in detail with reference to FIG. 3 to FIG. 3C in FIG. 3A to FIG. 3C, "a" shows the center of a case side circular cam 58, "b" shows the center of an eccentric shaft 57, and "c" shows the center of a block side circular cam 56. Note that, in the present embodiment, the diameter of the block side circular cam 56 is larger than the diameter of the case side circular cam 58. Accordingly, the distance between the center "c" of the block side circular cam 56 and the center "b" of the eccentric shaft 57 is longer than the distance between the center "a" of the case side circular cam 58 and the center "b"

of the eccentric shaft 57. Further, FIGS. 3A, 3B, and 3C show the positional relationship among the center "a" of the case side circular cam 58, the center "b" of the eccentric shaft 57, and the center "c" of the block side circular cam 56 in the respective states.

If driving the drive motor 59 from the state shown in FIG. 3A to make the cam shafts 54 and 55 rotate so that case side circular cams 58 rotate in the opposite directions to each other such as shown by the arrow marks in FIG. 3A, the eccentric shafts 57 move in directions away from each other. Along with this movement of the eccentric shafts 57, the block side circular cams 56 rotate in the block side cam insertion holes 51 in opposite directions from the case side circular cams 58. As a result, as shown in FIG. 3B, the positions of the eccentric shafts 57 change from the high positions to the medium height positions.

If further driving the drive motor 59 to make the cam shafts 54 and 55 rotate so that the case side circular cams 58 rotate in opposite directions to each. other as shown by the arrow marks in FIG. 3B, the eccentric shafts 57 move downward in the case side circular cams 58. Along with this movement of the eccentric shafts 57, the block side circular cams 56 rotate in the block side cam insertion holes 51 in the same direction as the case side circular cams 58. As a result, as shown in FIG. 3C, the eccentric shafts 57 are positioned at the lowest positions.

As will be understood from a comparison of FIG. 3A to FIG. 3C, the relative distance between the crankcase 1 and the cylinder block 2 is determined by the distance between the centers "a" of the case side circular cams 58 and the centers "c" of the block side circular cams 56. As the distance between the centers "a" of the case side circular cams 58 and the centers "c" of the block side circular cams 56 becomes larger, the cylinder block 2 moves away from the crankcase 1. That is, the variable compression ratio mechanism A uses the crank mechanism using the rotating cams to change the relative distance between the crankcase 1 and the cylinder block 2. Further, if the cylinder block 2 moves away from the crankcase 1, the volume of the combustion chambers 5 when the pistons 4 are positioned at compression top dead center increases. Therefore, by rotating the cam shafts 54 and 55, it is possible to change the volume of the combustion chambers 5 when the pistons 4 are positioned at compression top dead center (below, referred to as "combustion chamber volume").

In particular, in the example shown in FIGS. 3A to 3C, the cylinder block 2 moves relatively to the crankcase 1 by ΔD1 between the state shown in FIG. 3A and the state shown in FIG. 3B. The cylinder block 2 moves relative to the crankcase 1 by ΔD2 between the state shown in FIG. 3B and the state shown in FIG. 3C.

By rotating the cam shafts 54 and 55 in this way, even if changing the volume of the combustion chambers 5 when pistons 4 are positioned at compression top dead center, the stroke volume of the pistons 4 at the time of the compression stroke (volume of combustion chambers 5 changing when pistons 4 move from intake bottom dead center to compression top dead center) does not change. Therefore, the mechanical compression ratio expressed by (combustion chamber volume+stroke volume)/combustion chamber volume, as explained above, changes by changing the combustion chamber volume. That is, the variable compression ratio mechanism A of the present embodiment uses the drive motor 59 to rotate the cam shafts 54 and 55 and thereby change the relative distance between the cylinder block 2 and the crankcase 1. Due to this, it is possible to change the mechanical compression ratio of the internal combustion engine.

<<Control of Mechanical Compression Ratio>>

The optimum mechanical compression ratio considering the engine output and fuel economy, changes according to the engine operating state (state of internal combustion engine determined based on at least engine load and engine rotational speed). For example, in the region where the engine load is low, it is necessary to raise the mechanical compression ratio so as to maximize the thermal efficiency, while conversely in the region where the engine load is high, it is necessary to lower the mechanical compression ratio so as to maximize the engine output.

Therefore, in the present embodiment, the compression ratio controller of the control device sets the optimal mechanical compression ratio corresponding to the engine operating state as the target mechanical compression ratio, and controls the drive motor 59 of the variable compression ratio mechanism A so that actual mechanical compression ratio becomes the target mechanical compression ratio.

In this regard, in the present embodiment, the relative distance between the crankcase 1 and the cylinder block 2 is detected by the relative distance sensor 43. Further, the mechanical compression ratio of the internal combustion engine changes according to the relative distance between the cylinder block 2 and the crankcase 1. Therefore, it is possible to estimate the mechanical compression ratio of the internal combustion engine from the relative distance detected by the relative distance sensor 43. Below, the mechanical compression ratio estimated based on the relative distance detected by the relative distance sensor 43 in this way will be called the "detected value of the mechanical compression ratio by the relative distance sensor 43".

Therefore, in the present embodiment, it can be said that the compression ratio controller feedback controls the variable compression ratio mechanism A (in particular, its drive motor 59) so that the detected value of the mechanical compression ratio by the relative distance sensor 43 (that is, the mechanical compression ratio detected by the compression ratio detector) becomes the target mechanical compression ratio.

When performing feedback control in this way, for example, if a change in the engine operating state causes the target mechanical compression ratio to change, the cam shafts 54 and 55 are made to rotate by the drive motor 59 so that the value of the mechanism compression ratio detected by the relative distance sensor 43 matches the changed target mechanical compression ratio. Specifically, if the target mechanical compression ratio becomes higher, the cam shafts 54 and 55 are made to rotate by the drive motor 59 so that the distance between the crankcase 1 and the cylinder block 2 becomes shorter. As a result, the mechanical compression ratio becomes higher. Conversely, if the target mechanical compression ratio becomes lower, the cam shafts 54 and 55 are made to rotate by the drive motor 59 so that the distance between the crankcase 1 and the cylinder block 2 becomes longer. As a result, the mechanical compression ratio becomes lower.

Note that, in the embodiment, the relative distance sensor 43 detecting the relative distance between the crankcase 1 and cylinder block 2 is used for detecting the mechanical compression ratio. If considering the fact that the pistons 4 are connected to the crankcase 1, it may be considered that the relative distance sensor 43 substantially detects the relative positional relationship between the cylinder block 2 and the pistons 4 with respect to a crank angle (that is, the relative positional relationship between the cylinder block 2 and the pistons 4 excluding the change of the relative positional relationship between the cylinder block and the pistons based on the change of the crank angle).

However, it is also possible to use a device other than the relative distance sensor 43 so long as the device is able to detect the mechanical compression ratio based on the relative position parameter expressing the relative positional relationship between the cylinder block 2 and the pistons 4 with respect to the crank angle. This other device includes, for example, an angle sensor for detecting the rotational angular position of the cam shafts 54 and 55 at the end part at the opposite side from the end part at which the worm wheels 63 and 64 are attached.

<<Problems in Control of Mechanical Compression Ratio>>

Figure 4:
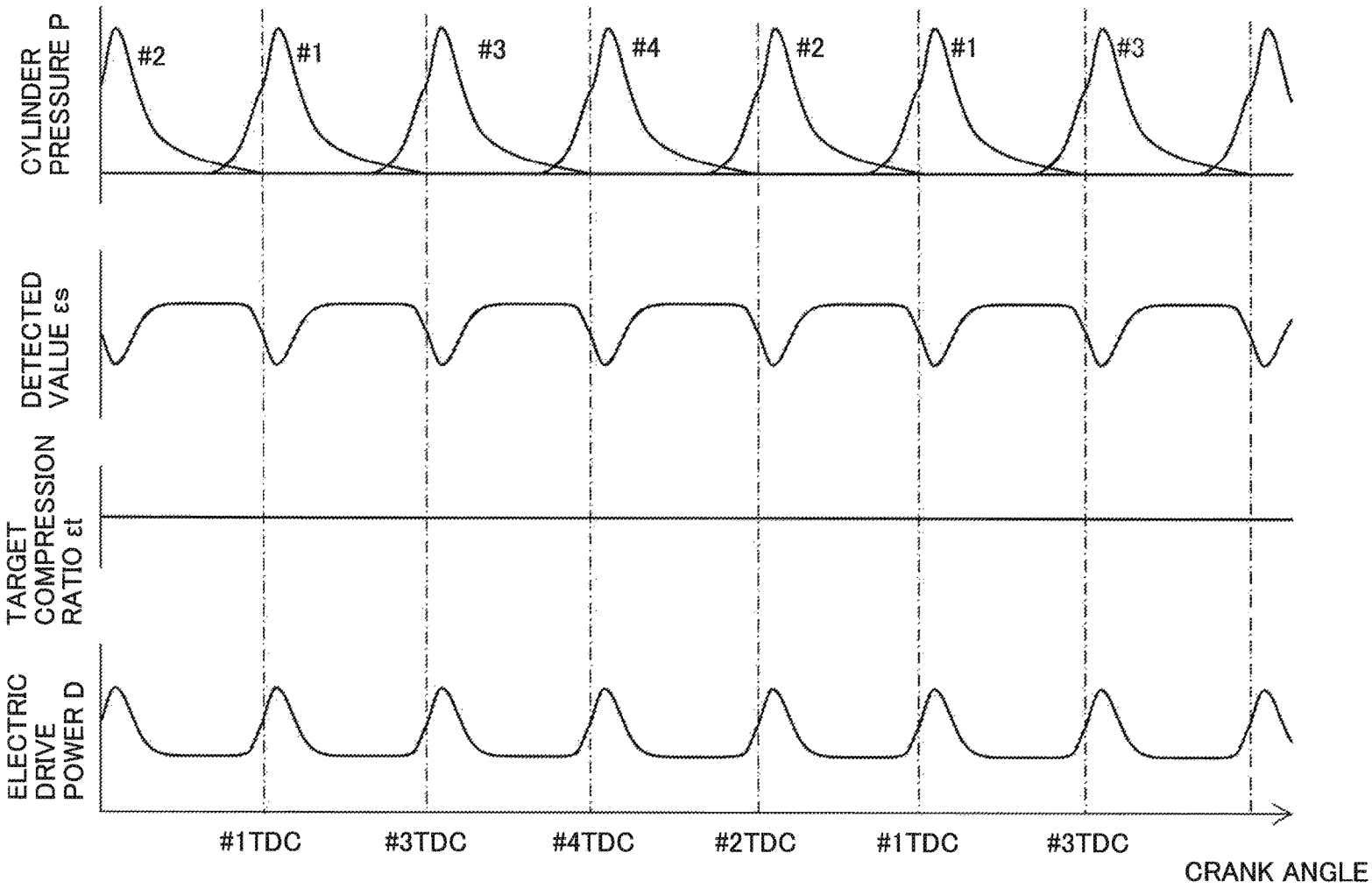
FIG. 4 is a view showing transitions in a cylinder pressure, detected compression ratio value, target mechanical compression ratio, and electric drive power, according to a crank angle.

Next, referring to FIG. 4, the problems occurring in the case of control of the mechanical compression ratio explained above, will be explained. FIG. 4 is a view showing the transitions in a pressure P in the combustion chamber 5 (cylinder pressure), detected value s of the mechanical compression ratio by the relative distance sensor 43 (hereinafter, referred to as the "detected compression ratio value"), target mechanical compression ratio εt, and electric drive power D supplied to the drive motor 59, at any cylinder, according to a crank angle. In the example shown in FIG. 4, the target mechanical compression ratio εt is maintained constant.

In the engine body 100 configured as explained above, if the air-fuel mixture is burned in a combustion. chamber 5 in any of the cylinders of the plurality of cylinders, along with this, an extremely large force is applied to the cylinder block 2 in the direction away from the crankcase 1 (axial direction of the cylinders). If such a large force acts on the cylinder block 2, torsion occurs at the cam shafts 54 and 55, and/or the block side projections of the cylinder block 2 deform in the axial direction of the cylinders.

If torsion occurs at the cam shafts 54 and 55 along with combustion in the combustion chambers 5 in this way, due to the torsion, the cylinder block 2 moves away relatively from the crankcase 1. Similarly, if the block side project ions 50 of the cylinder block 2 deform along with combustion in the combustion chambers 5, due to this deformation, the cylinder block 2 moves away relatively from the crankcase 1. As a result, the detected compression ratio value εs falls.

After that, if the cylinder pressure P falls, the torsion which occurred at the cam shafts 54 and 55 returns to the original level. Further, the deformation which occurred at the block side projections 50 also returns to the original level. Therefore, the cylinder block 2 moves to relatively approach the crankcase 1. As a result, the detected compression ratio value εs returns to the value before the cylinder pressure P in the combustion chambers 5 rises.

This situation is shown in FIG. 4. As will be understood from FIG. 4, combustion in each cylinder occurs right after compression top dead center of the cylinder, therefore the cylinder pressure P also peaks right after compression top dead center of each cylinder. For example, the cylinder pressure P of the #1 cylinder gradually rises along with the rise of the piston before compression top dead center of the #1 cylinder (#1TDC). Then, combustion occurs right after compression top dead center. Along with this, the cylinder pressure P of the #1 cylinder rapidly rises and reaches its peak, then falls along with the descent of the piston. Such fluctuation of the cylinder pressure P occurs with each combustion in a cylinder. FIG. 4 shows an example of a four-cylinder internal combustion engine. Combustion. occurs four times while the crankshaft rotates twice, and therefore the cylinder pressure P peaks each time the crankshaft rotates about 180°.

Along with such fluctuation of the cylinder pressure P in each cylinder, torsion occurs at the cam shafts 54 and 55 and deformation occurs at the block side projections 50. For this reason, as shown in FIG. 4, every time combustion occurs in the cylinders, that is, each time the cylinder pressure P becomes larger in the cylinders, the detected compression ratio value εs temporarily falls.

In this regard, as explained above, in the present embodiment, the drive motor 59 of the variable compression ratio mechanism A is feedback controlled so that the detected compression ratio value εs becomes the target mechanical compression ratio εt. Therefore, if the target mechanical compression ratio εt is constant, when the detected compression ratio value εs falls, the drive motor 59 is driven so as to make the mechanical compression ratio rise by that amount to return the detected compression ratio value εs to the original level. As a result, as shown in FIG. 4, the electric drive power supplied to the drive motor 59 of the variable compression ratio mechanism. A fluctuates along with the detected compression ratio value εs.

However, when torsion occurred at the cam shafts 54 and 55 and thereby the detected compression ratio value εs fell, even if not driving the drive motor 59, the detected compression ratio value εs naturally returns to the original level. Therefore, in this case, it is not necessary to fluctuate the electric drive power D supplied to the drive motor 59 so as to match the detected compression ratio value εs. If fluctuating the electric drive power D so as to match the detected. compression ratio value εs, the drive motor 59 ends up being wastefully driven.

<<Control in Present Embodiment>>

Figure 5:
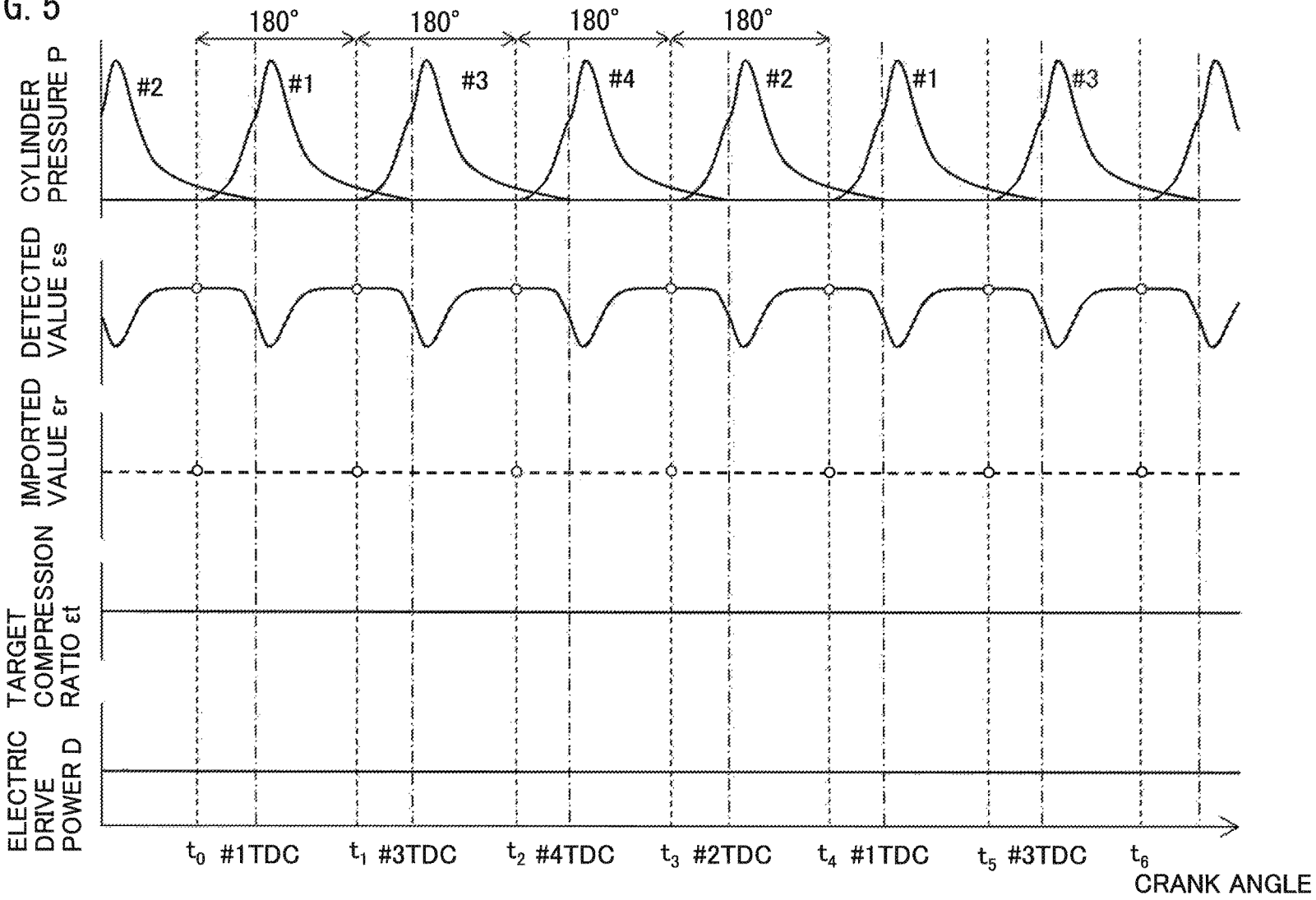
FIG. 5 is a view, similar to FIG. 4, showing transitions in a cylinder pressure, detected compression ratio value, imported compression ratio value, target mechanical compression ratio, and electric drive power, according to a crank angle.

Next, referring to FIG. 5, a control method of the variable compression ratio mechanism A according to the present embodiment will be explained. FIG. 5 is a view, similar to FIG. 4, showing the transitions in the cylinder pressure P, detected compression ratio value εs, imported value εr of the mechanical compression ratio imported from the relative distance sensor 43 into the RAM 33 of the ECU 30 (below, refer to "imported compression ratio value"), target mechanical compression ratio εt, and electric drive power D, according to the crank angle. Note that, the white circles in FIG. 5 show the timings where the detected compression ratio value εs is imported and the imported compression ratio value εr is updated.

As will be understood from FIGS. 4 and 5, the detected compression ratio value εs fluctuates near the timing when combustion occurs and the cylinder pressure reaches the peak at each cylinder, that is, near compression top dead center of each cylinder. However, on the other hand, at a timing near the middle of the compression top dead center of each cylinder and compression top dead center of the cylinder when combustion is next performed, the cylinder pressure P is in a relatively low state at each cylinder. In this way, at the timing where the cylinder pressure P is in a relatively low state at any cylinder, the detected compression ratio value εs does not fluctuate much at all and the current actual mechanical compression ratio is accurately reflected.

Therefore, the compression ratio controller of the present embodiment is configured to use the detected compression ratio value εs detected at a specific crank angle where the cylinder pressure is in a relatively low state at each of the cylinders to control the drive motor 59 of the variable compression ratio mechanism A. In particular, as shown in FIG. 5, the present embodiment uses the detected compression ratio value εs detected at a timing when the crank angle based on compression top dead center of each cylinder becomes 110° (110° ATDC), to control the drive motor 59 of the variable compression ratio mechanism A.

Specifically, at the timing $t_1$ when the crank angle based on compression top dead center of the #1 cylinder becomes 110° ATDC, the value of the mechanical compression ratio detected by the relative distance sensor 43, that is, the detected compression ratio value εs, is imported into the RAM 33 of the ECU 30, and the imported compression ratio value εr stored in the RAN 33 is updated. Next, at the timing $t_2$ when the crank angle based on compression top dead center of the #3 cylinder whose piston reaches compression top dead center after the #1 cylinder, becomes 110° ATDC (at the crank angle based on compression top dead center of the #1 cylinder, 290°), the detected compression ratio value εs is imported into the RAM 33 of the ECU 30, and the imported compression ratio value εr is updated. In other words, from the timing $t_1$ when the crank angle based on compression top dead center of the #1 cylinder becomes 110° ATDC to the timing $t_2$ when the crank angle based on compression top dead center of the #3 cylinder becomes 110° ATDC, the detected compression ratio value εs is not imported. Therefore, from the timing $t_1$ to the timing $t_2$, the detected compression ratio value εs at the timing $t_1$ when the #1 cylinder becomes 110° ATDC is stored in the RAM 33. This value is used for feedback control by the compression ratio controller.

Similarly, at the timing $t_3$ when the crank angle based on compression top dead center of the #4 cylinder whose piston reaches compression top dead center after the #3 cylinder, becomes 110° ATDC (at the crank angle based on compression top dead center of the #1 cylinder, 470°), the detected compression ratio value εs is imported into the RAM 33 of the ECU 30, and the imported compression ratio value εr is updated. Then, at the timing $t_4$ when the crank angle based on compression top dead center of the #2 cylinder whose piston reaches compression top dead center after the #4 cylinder, becomes 110° ATDC (at the crank angle based on compression top dead center of the #1 cylinder, 650°), the detected compression ratio value εs is imported into the RAM 33 of the ECU 30, and the imported compression ratio value εr is updated. Further, from the timing $t_2$ to the Liming $t_3$, the detected compression ratio value εs at the timing $t_2$ when the crank angle based on compression top dead center of the #3 cylinder becomes 110° ATDC, is used as the imported compression ratio value εr for feedback control. Similarly, from the timing $t_3$ to the timing $t_4$, the detected compression ratio value εs at the timing $t_3$ when the crank angle based on compression top dead center of the #4 cylinder becomes 110'ATDC, is used as the imported compression ratio value εr for feedback control. Then, such an operation is repeated.

By using the detected compression ratio value εs detected at a specific crank angle where the cylinder pressure P is in a relatively low state in each of the cylinders in this way so as to control the drive motor 59 of the variable compression ratio mechanism A, it is possible to eliminate the effects of fluctuation of the detected compression ratio value εs accompanying fluctuation of the cylinder pressure P. Due to this, the drive motor 59 is no longer wastefully driven and accordingly wasteful energy consumption can be suppressed.

Further, the present embodiment uses the detected compression ratio value εs detected at a preset specific crank angle to control the drive motor 59 of the variable compression ratio mechanism A. Even if the cylinder pressure P is in a relatively low state, if the crank angle differs, even if the actual mechanical compression ratio is the same, the detected compression ratio value εs changes somewhat along with fluctuation of the cylinder pressure P. In the present embodiment, the detected compression ratio value εs detected at a preset specific crank angle is used, therefore it is possible to more reliably eliminate the effects of fluctuation of the detected compression ratio value εs accompanying fluctuation of the cylinder pressure P.

Note that, in this Description, the crank angle where the detected compression ratio value εs used for the control of the variable compression ratio mechanism A is detected, that is, the crank angle where the detected compression ratio value εs is imported into the RAN 33 and the imported compression ratio value εr is updated, will be called the "detection crank angle". In the above-mentioned embodiment, the timing at which the crank angle based on compression top dead center of each cylinder becomes 110° ATDC, that is, the timing at which the crank angle based on compression top dead center of the #1 cylinder becomes 110°, 290°, 470°, and 650°, is the detection crank angle.

In the meantime, when the engine rotational speed is slow, the frequency of the crank angle reaching the above-mentioned detection crank angle per unit time is low. Therefore, when the engine rotational speed is slow, if the variable compression ratio mechanism A is controlled, as explained above, by using only the detected compression ratio value detected at the detection crank angle, the current mechanical compression. ratio can no longer be accurately grasped and as a result the variable compression ratio mechanism A can no longer be suitably controlled.

Therefore, in the present embodiment, in feedback controlling the variable compression ratio mechanism A, the compression ratio controller uses not the detected compression ratio value at the detection crank angle, but as much as possible the detected compression ratio value regardless of the crank angle, when the engine rotational speed is less than a predetermined reference rotational speed (for example, 200 rpm) lower than the idling rotational speed (for example, 700 rpm). In particular, in the present embodiment, when the engine rotational speed is less than the reference rotational speed, at the ECU 30, the detected compression ratio value εs is imported into the RAM 33 and the imported compression ratio value εr is updated, every several milliseconds. Therefore, at this time, it can be said that the detected compression ratio value εs detected every several milliseconds is being used for control of the variable compression ratio mechanism A. That is, in the present embodiment, it can be said that in feedback controlling the variable compression ratio mechanism A, the compression ratio controller uses a mechanical compression ratio detected at a predetermined time interval (at least interval shorter than time taken for crank angle to reach from certain detection crank angle to next detection crank angle) regardless of the crank angle, when the engine rotational speed is less than a reference rotational speed.

Further, in the embodiment, the detected compression ratio value εs detected at the detection crank angle is imported into the RAM 33 and the imported compression ratio value εr is updated. This imported compression ratio value εr is used for control of the variable compression ratio mechanism A. As this detection crank angle, the timing when the crank angle based on compression top dead center of each cylinder becomes 110° ATDC is set. In the embodiment, the engine body 100 has four cylinders, therefore this detection crank angle is set every 180°. If considering other than four-cylinder internal combustion engines, the detection crank angle can be set at every angle obtained by dividing 720' by the number of cylinders.

<<Modification of First Embodiment>>

Figure 6:
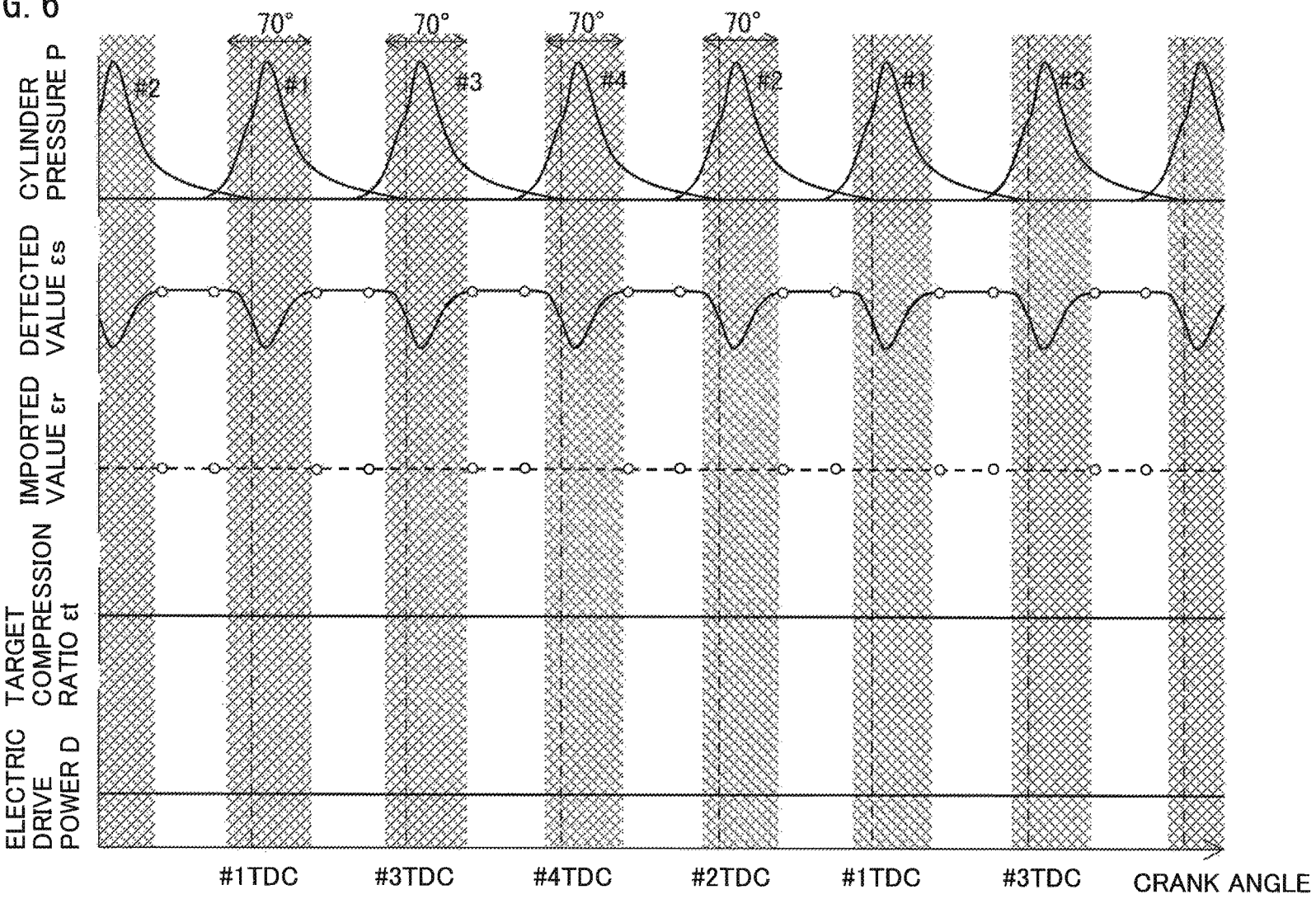
FIG. 6 is a view, similar to FIG. 5, showing transitions in a cylinder pressure, detected compression ratio value, imported compression ratio value, target mechanical compression ratio, and electric drive power, according to a crank angle.

Next, referring to FIG. 6, a modification of the control device of the first embodiment will be explained. FIG. 6 shows transitions, in the same way as FIG. 5, in the cylinder pressure P, detected compression ratio value εs, imported compression ratio value εr, target mechanical compression ratio εt, and electric drive power D, according to the crank angle. In FIG. 6 as well, the white circles in the figure show the timings where the detected compression ratio value εs is imported into the RAM 33 and the imported compression ratio value εr is updated.

In this regard, in the first embodiment, the detection crank angle is a timing becoming 110° ATDC based on compression top dead center of each cylinder, and therefore the detected compression ratio value εs is imported into the RAM 33 and the imported compression ratio value εr is updated one time per 180° of crank angle. However, the timing when the detected compression ratio value εs is imported into the RAM 33 and the imported compression ratio value εr is updated, is not necessarily one time per 180° of crank angle. Therefore, for example, as shown in FIG. 6, the detected compression ratio value εs may be imported into the RAM 33 and the imported compression ratio value εr updated two times per 180° of crank angle (or number greater than that). In the example shown in FIG. 6, the detected compression ratio value εs is imported into the RAM 33 at the timing when becoming 70° ATDC and 130° ATDC based on compression top dead center of each cylinder.

However, the detection crank angle has to be a crank angle where the cylinder pressure is a relatively low state at each cylinder. Therefore, the detection crank angle has to be a crank angle where the cylinder pressure becomes less than a predetermined given reference pressure (for example, pressure causing fluctuation of the detected compression ratio value such as returning to the original level due to a drop in the cylinder pressure) at each cylinder. Therefore, in the modification of the present embodiment, the detection crank angle is set outside a predetermined crank angle range including a time period where the cylinder pressure is equal to or greater than a preset predetermined reference pressure at any cylinders.

Specifically, the "predetermined crank angle range" means, for example, the range of 0° ATDC to 30° ATDC based on compression top dead center of each cylinder. In this case, the detection crank angle is set outside the range of 0° ATDC to 30° ATDC based on compression top dead center of each cylinder. Further, the predetermined crank angle range is preferably a range of −10° ATDC to 40° ATDC based on compression top dead center of each cylinder. More preferably, the predetermined crank angle range is a range of −20° ATDC to 50° ATDC based on compression top dead center of each cylinder (hatched range in FIG. 6). In this case, the detection crank angle is set outside the range of −20° ATDC to 50° ATDC based on compression top dead center of each cylinder (not hatched range in FIG. 6).

<<Explanation of Control Using Flow Chart>>

Figure 7:
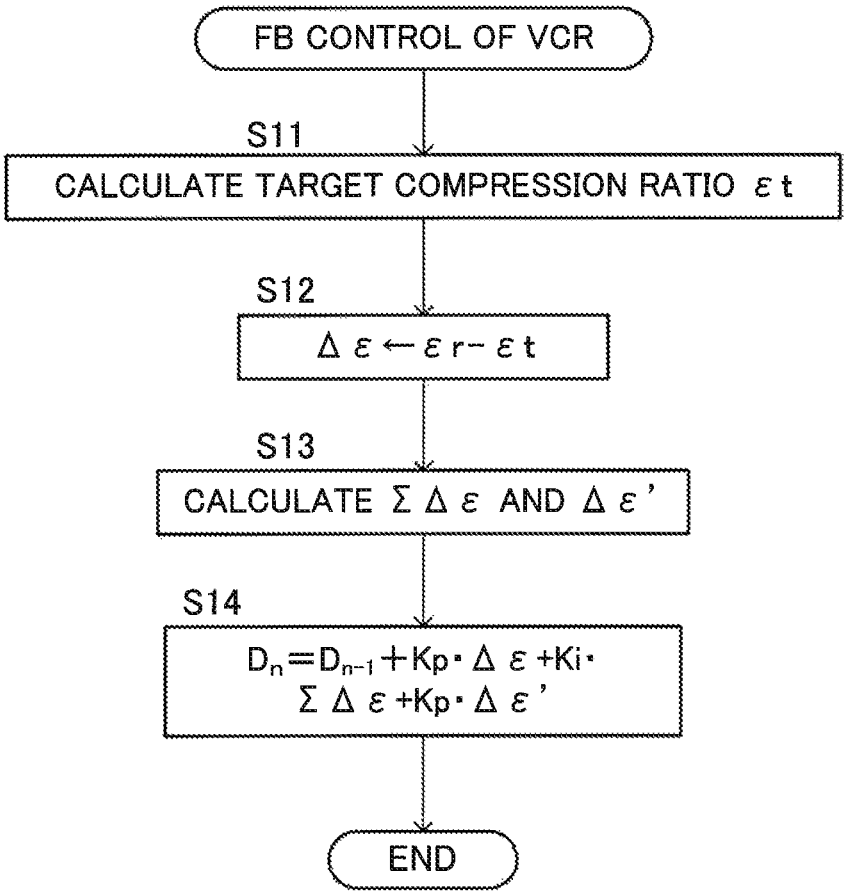
FIG. 7 is a flow chart showing a control routine of feedback control of a variable compression ratio mechanism.

Next, referring to FIGS. 7 to 9, specific control of the variable compression ratio mechanism A according to the present embodiment will be explained. FIG. 7 is a flow chart showing the control routine of feedback control of the variable compression ratio mechanism A. The illustrated control routine is executed at constant time intervals (for example, 4 ms).

First, at step S11, the target mechanical compression ratio εt is calculated based on the engine operating state. Specifically, the relationship between the engine load and engine rotational speed, and the optimum target mechanical compression ratio εt is found in advance and stored as a map in the ROM 32 of the ECU 30. In this map, basically, it is set so that the higher the engine load, the lower the target mechanical compression ratio εt becomes and so that the higher the engine rotational speed, the higher the target mechanical compression ratio εt becomes. Further, at step S11, the target mechanical compression ratio εt is calculated based on the engine load detected by the load sensor 41 and the engine rotational speed detected by the crank angle sensor 42, using the preset map.

Next, at step S12, by the compression ratio importing control explained later referring to FIG. 8, the target mechanical compression ratio εt is subtracted from the imported compression ratio value εr imported into the RAM of the ECU 30, to calculate the compression ratio difference Δε (Δε=εr−εt). Next, at step S13, for use for the integral control, the integrated value ΣΔε of the compression ratio difference Δε is calculated based on the following equation (1). In addition, for use for differential control, the difference Δε'between the compression ratio difference Δε calculated the previous time and the compression ratio difference Δε calculated the current time is calculated based on the following equation (2). Note that, in the following equations (1) and (2), "n" shows the number of times of calculation. A parameter with "n" attached shows the value calculated at the current control routine, while a parameter with "n−1" attached shows the value calculated at the previous control routine:

$$\Sigma\Delta\varepsilon_n=\Sigma\Delta\varepsilon_{n-1}+\Delta\varepsilon_0 \quad (1)$$

$$\Delta\varepsilon'=\Delta\varepsilon_n-\Delta\varepsilon_{n-1} \quad (2)$$

Next, at step S14, based on the following equation (3), the electric drive power D to be supplied to the drive motor 59 of the variable compression ratio mechanism A is calculated and then the control routine is ended. Power corresponding to the value of the electric drive power D calculated is supplied to the drive motor 59 of the variable compression ratio mechanism A:

$$D_n=D_{n-1}+Kp\cdot\Delta\varepsilon_n+Ki\cdot\Sigma\Delta\varepsilon_n+Kd\cdot\Delta\Sigma'_n \quad (3)$$

Note that, in equation (3), Kp shows a proportional constant, Ki an integral constant, and Kp a differential constant. Therefore, the present control routine shows the case of PID control of the drive motor 59 of the variable compression ratio mechanism A based on the imported compression ratio value εr. However, the feedback control based on the imported compression ratio value εr is not necessarily PID control. The feedback control may be performed by any control technique so long as a generally used feedback control technique such as P control and PI control.

Figure 8:
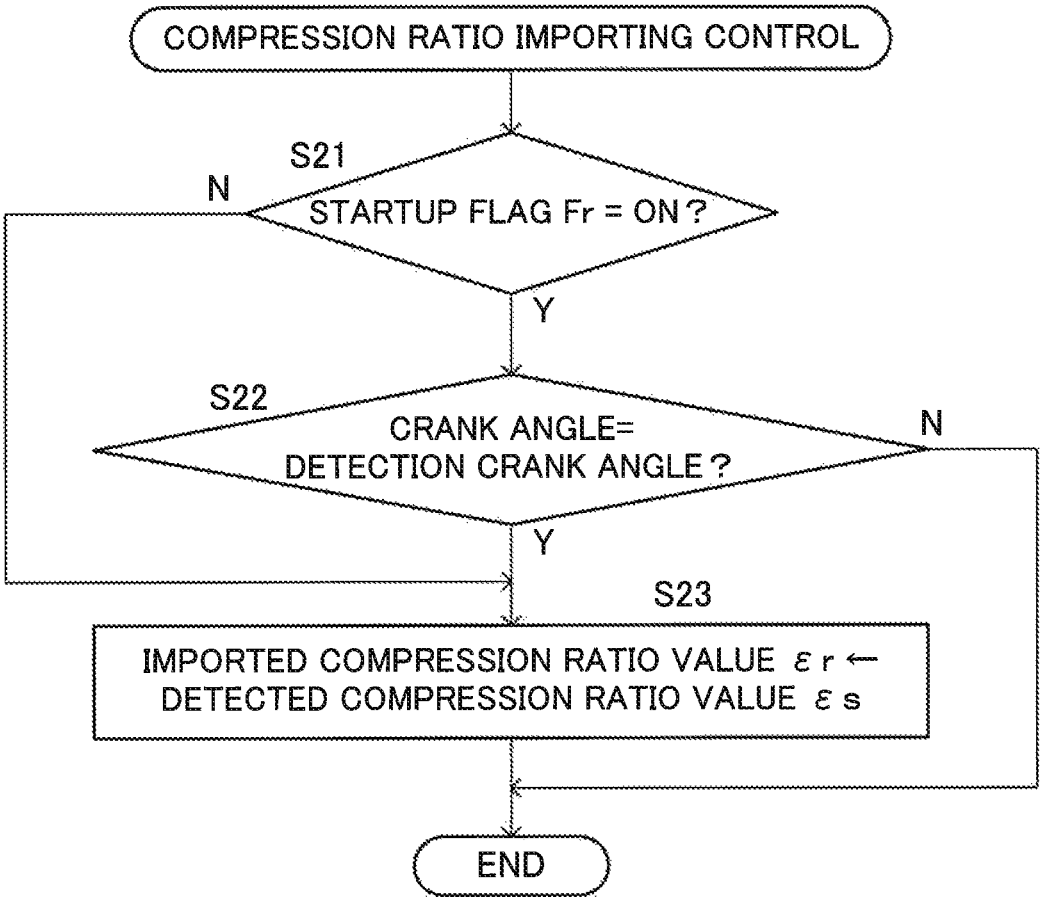
FIG. 8 is a flow chart showing a control routine of compression ratio importing control for importing a detected compression ratio value into a RAM.

FIG. 8 is a flow chart showing a control routine of compression ratio importing control for importing a detected compression ratio value to the PAM 33. The illustrated control routine is executed at constant time intervals (for example, 4 ms).

As shown in FIG. 8, first, at step S21, it is detected if the startup flag Fr is set ON. The startup flag Fr is a flag which is set ON when it is judged that the engine rotational speed has become equal to or greater than the reference rotational speed and thus the internal combustion engine has been started up, and which is set OFF at other times. The flag Fr is set in the startup judgment control shown in FIG. 9. When at step S21 it is judged that the engine rotational speed is less than the reference rotational speed and thus the startup flag Fr has been set. OFF, the routine proceeds to step S23.

At step S23, the detected value εs of the mechanical compression ratio detected by the relative distance sensor 43 at the time of current execution of the control routine is imported into the RAM 33 and the imported compression ratio value εr is updated to this detected value εs. Therefore, while the startup flag Fr is set to OFF, each time the control routine is executed, the detected compression ratio value εs is imported into the RAM 33 at step S23 and the imported compression ratio value εr is updated. Therefore, if it is judged that the startup flag Fr has been set to OFF, the detected compression ratio value εs is imported into the RAM 33 and the imported compression ratio value εr is updated at a time interval equal to the time interval of execution of the control routine (in the present embodiment, 4 ms).

On the other hand, if at step S21 it is judged that the startup flag Fr is set ON, the routine proceeds to step S22. At step S22, it is judged if the current crank angle is the detection crank angle. If at step S22 it is judged that the current crank angle is not the detection crank angle, the control routine ends. On the other hand, if at step S22 it is judged that the current crank angle is the detection crank angle, the routine proceeds to step S23 where the detected compression ratio value εs at that time is imported into the RAM 33 and the imported compression ratio value εr is updated. Therefore, if it is judged that the startup flag Fr is set ON, the detected compression ratio value εs is imported into the RAM 33 only when the current crank angle is the detection crank angle and the imported compression ratio value εr is updated. The imported compression ratio value εr imported into the RAM 33 in this way is used at step S12 of the above-mentioned FIG. 7.

Figure 9:
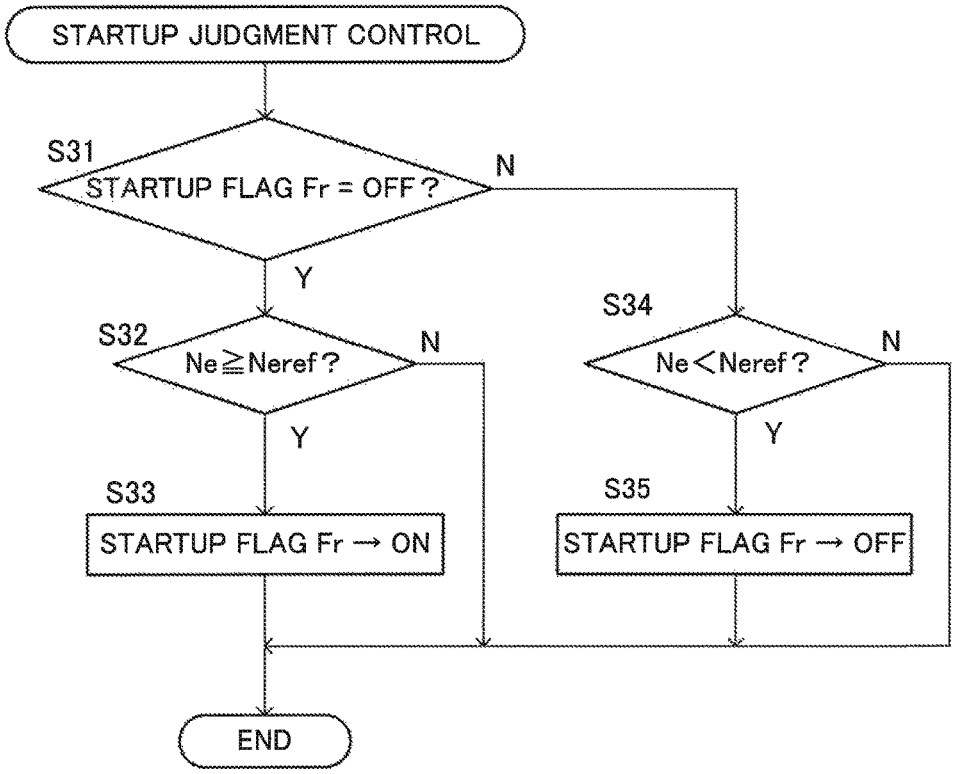
FIG. 9 is a flow chart showing a control routine of startup judgment control for judging startup of an internal combustion engine.

FIG. 9 is a flow chart showing a control routine of startup judgment control for judging startup of the internal combustion engine. The illustrated. control routine is executed at constant time intervals (for example, 4 ms).

As shown in FIG. 9, first, at step S31, it is judged if currently the startup flag Fr is set to OFF. If it is judged that the startup flag Fr has been set to OFF, the routine proceeds to step S32. At step S32, it is judged if the engine rotational speed Ne is equal to or greater than the reference rotational speed Neref. If it is judged that the engine rotational speed Ne is less than the reference rotational speed Neref, the startup flag Fr is left OFF and the control routine is ended.

On the other hand, when the engine rotational speed rises and thus at step S31 it is judged that the engine rotational speed Ne is equal to or greater than the reference rotational speed Neref, the routine proceeds to step S33. At step S33, the startup flag Fr is set ON and the control routine is ended.

On the other hand, if at step S31 it is judged. that currently the startup flag Fr is set ON, the routine proceeds to step S34. At step S34, it is judged if the engine rotational speed. Ne is less than a reference rotational speed Neref. If at step S34 it is judged that the engine rotational speed Ne is equal to or greater than the reference rotational speed Neref, the startup flag Fr is left ON as it is and the control routine is ended. On the other hand, if the engine rotational speed falls due to such as the engine being stopped and thus at step S34 it is judged that the engine rotational speed Ne is less than the reference rotational speed Neref, the routine proceeds to step S35. At step S35, the startup flag Fr is set to OFF and the control routine is ended.

Second Embodiment

<<Control in Second Embodiment

Next, referring to FIGS. 10 and 11, a control device of an internal combustion engine according to a second embodiment will be explained. The configuration of the control device according to the second embodiment is basically similar to the control device according to the first embodiment. Below, the parts different from the control device according to the first embodiment will be focused on for the explanation.

In the control device according to the first embodiment, a detected compression ratio value εs detected at a preset detection crank angle is used to control the variable compression ratio mechanism A. Specifically, in the control device according to the first embodiment, the detected compression ratio value εs detected at the detection crank angle is imported into the RAM 33 and the imported compression ratio value εr is updated.

However, when the number of detection crank angles set per cycle is not large (for example, as shown in FIG. 5, when the number of detection crank angles set per cycle is four), the frequency of importing the detected compression ratio value εs per cycle is low, and. thus the frequency of updating the imported compression ratio value εr is low. Therefore, for example, during the time period for driving the variable compression ratio mechanism A to change the mechanical compression ratio, etc., a difference occurs between the imported compression ratio value εr, used for control of the variable compression ratio mechanism A, and the actual mechanical compression ratio.

If considering the error in the imported. compression ratio value εr due to the low frequency of importing the detected compression ratio value εs in this way, when the cylinder pressure is a relatively low state in each cylinder, it is preferable to raise the frequency of importing the detected compression ratio value εs to increase the frequency of updating the imported compression ratio value εr. Therefore, in the present embodiment, in feedback controlling the variable compression ratio mechanism A, the compression ratio controller as much as possible uses the detected compression ratio value outside a predetermined crank angle range including a time period where the cylinder pressure is equal to or greater than a preset predetermined reference pressure in any cylinders.

In particular, in the present embodiment, when the crank angle is outside of a predetermined crank angle range, in the ECU 30, the detected compression ratio value εs is imported into the RAM 33 and the imported compression ratio value εr is updated every several milliseconds. Therefore, in the present embodiment, it can be said that the detected compression ratio value εs detected every several milliseconds is being used for control of the variable compression ratio mechanism A. That is, in the present embodiment, it can be said that in feedback controlling the variable compression ratio mechanism, the compression ratio controller uses a mechanical compression ratio detected at a predetermined time interval (for example, interval of execution of control routine by ECU 30 or time interval of several times of the interval of execution) regardless of the crank angle, when the crank angle is outside the predetermined crank angle range.

Figure 10:
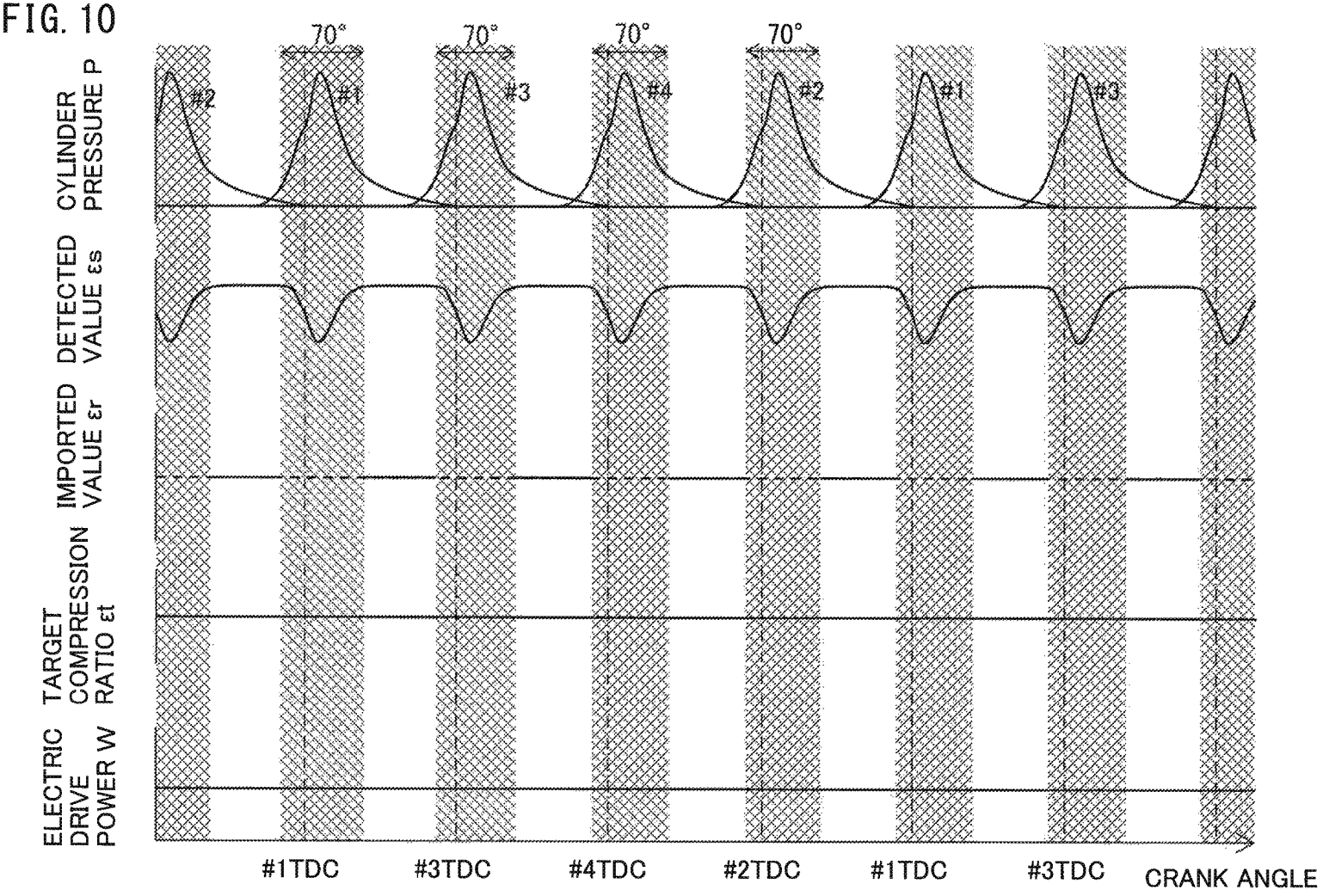
FIG. 10 is a view, similar to FIG. 6, showing transitions in a cylinder pressure, detected compression ratio value, imported compression ratio value, target mechanical compression ratio, and electric drive power, according to a crank angle.

FIG. 10 is a view, similar to FIG. 6, showing the transitions in the cylinder pressure F, detected compression ratio value εs, imported compression ratio value εr, target mechanical compression ratio εt, and electric drive power D, according to the crank angle. In FIG. 10, the solid line of the imported compression ratio value εr shows when the detected compression ratio value εs is imported into the RAM 33 and the imported compression ratio value εr is updated every several milliseconds, while the broken line of the imported compression ratio value εr shows when the detected compression ratio value εs is not imported into the RAM 33 and therefore the imported compression ratio value εr is not updated.

FIG. 10 shows the case where the predetermined crank angle range is the range of −20° ATDC to 50° ATDC based on compression top dead center of each cylinder. Therefore, as will be understood from FIG, 10, when the crank angle is in the range of −20° ATDC to 50° ATDC based on compression top dead center of each cylinder, the detected compression ratio value εs is not imported into the RAM 33. For this reason, during this period, the imported compression ratio value εr is maintained at the value updated right before the crank angle becomes −20° ATDC based on compression top dead center of each cylinder. On the other hand, when the crank angle is outside the range of −20° ATDC to 50° ATDC based on compression top dead center of each cylinder, the detected compression ratio value εs is imported into the RAM 33 each time the ECU 30 executes the control routine. Along with this, the imported compression ratio value εr is updated.

In the present embodiment, when the cylinder pressure is in a relatively low state in each of the cylinders (that is, when the crank angle is outside the predetermined crank angle range including a time period when the cylinder pressure is equal to or greater than a predetermined reference pressure in all of the cylinders), the detected compression ratio value is imported with a high frequency. Due to this, it is possible to keep a difference from being formed between the imported compression ratio value εr used for control of the variable compression ratio mechanism A and the actual mechanical compression ratio, and thus possible to raise the speed of control to the target mechanical compression ratio.

Note that, in the example shown in FIG. 10, the predetermined crank angle range is −20° ATDC to 50° ATDC based on compression top dead center of the cylinders. However, the predetermined crank angle range is set in the same way as the modification of the first embodiment. Therefore, the predetermined crank angle range may also be a range of 0° ATDC to 30° ATDC based on compression top dead center of each cylinder or may be a range of −10° ATDC to 40°0 ATDC based on compression top dead center of each cylinder.

<<Explanation of Control Using Flow Chart>>

Next, referring to FIG. 11, specific control of the variable compression ratio mechanism A according to the present embodiment will be explained. The feedback control of the variable compression ratio mechanism A is performed in the present embodiment as well by a control routine similar to the control routine shown in FIG. 7, and therefore the explanation will be omitted. Similarly, regarding the startup judgment control for judging startup of the internal combustion engine as well, in the present embodiment as well, control is performed by a control routine similar to the control routine shown in FIG. 9, and therefore the explanation will be omitted.

Figure 11:
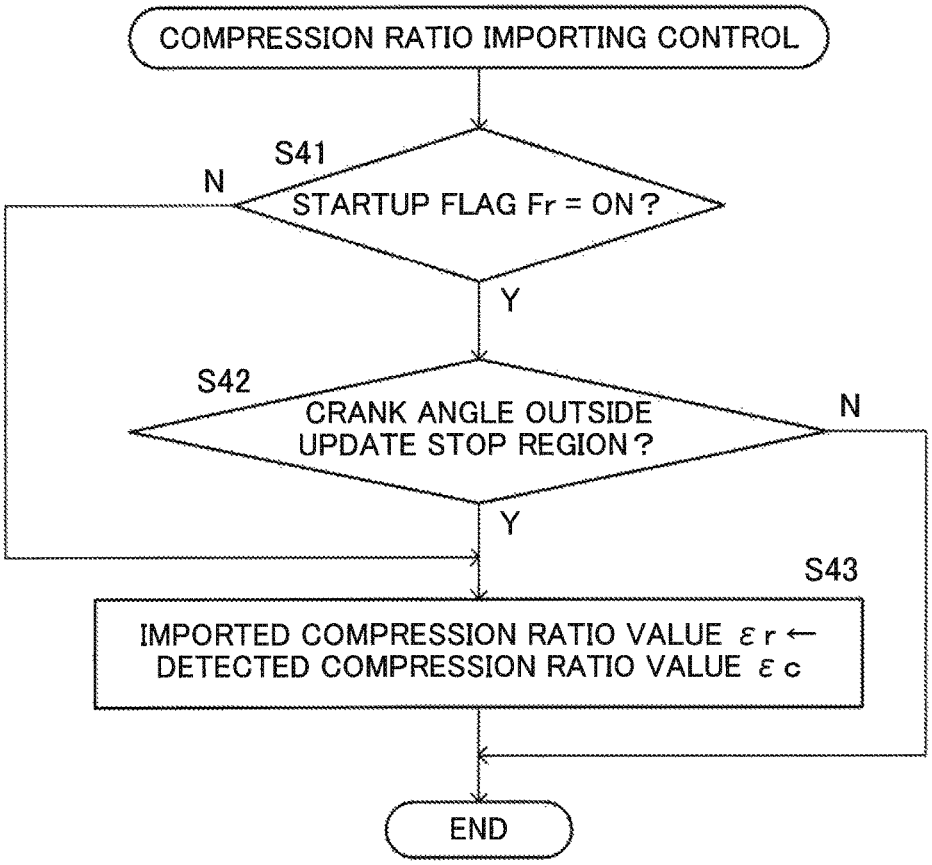
FIG. 11 is a flow chart, similar to FIG. 8, showing a control routine of compression ratio importing control for importing a detected compression ratio value into a RAM.

FIG. 11 is a flow chart, similar to FIG. 8, showing the control routine of compression ratio importing control for importing the detected compression ratio value into the RAM 33. The illustrated control routine is executed at constant time intervals (for example, 4 ms).

As shown in FIG. 11, first, at step S41, it is judged if the startup flag Fr is set ON. If at step S41 it is judged that the engine rotational speed is less than the reference rotational speed and thus the startup flag Fr is set to OFF, the routine proceeds to step S43. At step S43, the detected value εs of the mechanical compression ratio detected by the relative distance sensor 43 at the time of current execution of the control routine is imported into the RAM 33, and the imported compression ratio value εr is updated to this detected value εs.

On the other hand, when at step S41 it is judged that the startup flag Fr is set ON, the routine proceeds to step S42. At step S42, it is judged if the current crank angle is outside the update stopping region, that is, if the current crank angle is outside the predetermined crank angle range. When at step S42 it is judged that the current crank angle is in the update stopping region (in predetermined crank angle range), the control routine is ended. On the other hand, if at step 342 it is judged that the current crank angle is outside the update stopping region, the routine proceeds to step 343 where the detected compression ratio value εs at this time is imported into the RAM 33 and the imported compression ratio value εr is updated. Therefore, when it is judged that the startup flag Fr has been ON, the detected compression ratio value εs is imported into the RAM 33 and the imported compression ratio value εr is updated only when the current crank angle is outside the updating stop region. The imported compression ratio value εr imported into the RAM 33 in this way is used at step S12 of the above-mentioned FIG. 7.

Third Embodiment

Next, referring to FIGS. 12 to 15, a control device of an internal combustion engine according to a third embodiment will be explained. The configuration of the control device according to the third embodiment is basically similar to the control devices according to the first and second embodiments. Below, parts different from the control devices of the first and second embodiments will be focused on in the explanation.

In the meantime, the example shown in FIG. 4 shows the case where the fluctuation of the detected compression ratio value εs accompanying fluctuation of the cylinder pressure P occurs similarly for all cylinders. However, even if fluctuation of the cylinder pressure P caused by combustion of the air-fuel mixture in a combustion chamber 5 similarly occurs in the cylinders, the fluctuations in the detected compression ratio value εs accompanying this will sometimes differ among the cylinders. Below, referring to FIGS. 12 and 13, this phenomenon will be explained.

Figure 12:
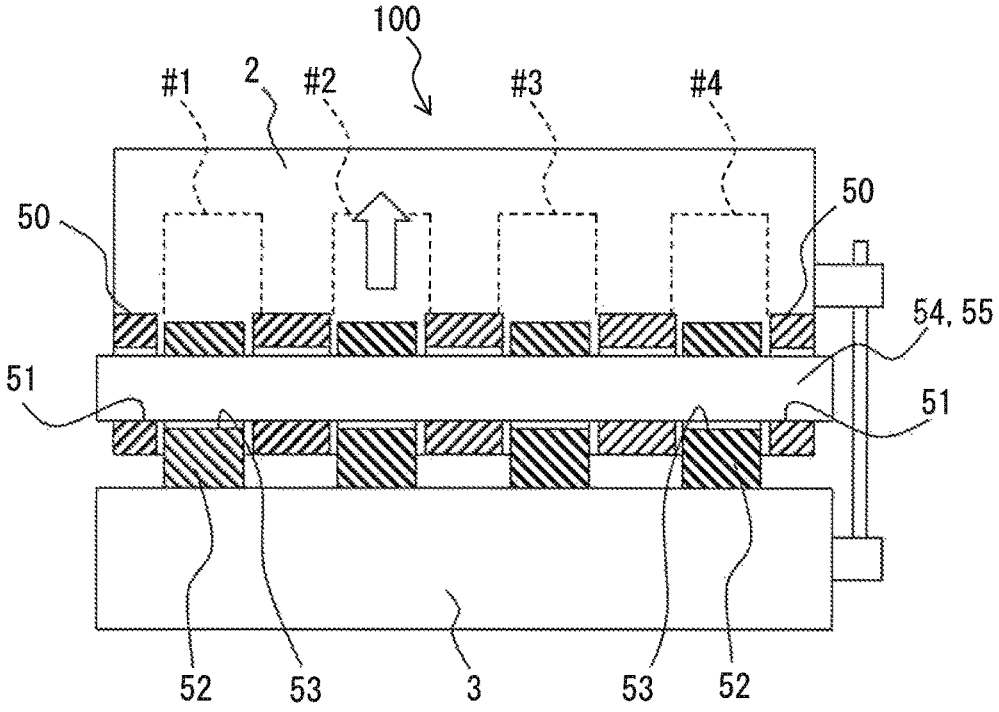
FIG. 12 is a schematic partial cross-sectional side view of an engine body.
Figure 13:
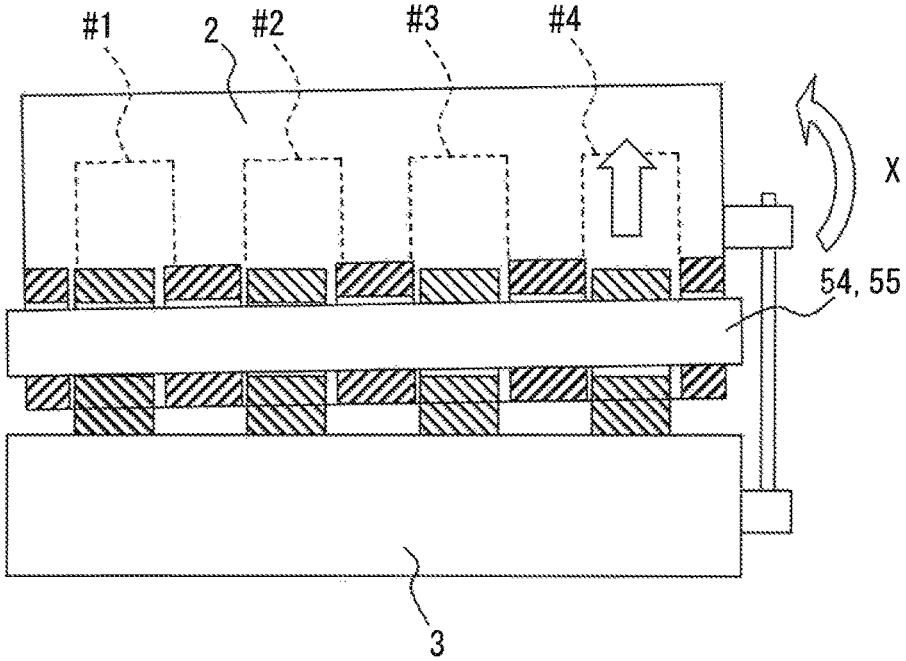
FIG. 13 is a schematic partial cross-sectional side view of an engine body.

FIGS. 12 and 13 are schematic partially cross-sectional side views of the engine body 100. FIG. 12 shows the case where combustion occurs at the #2 cylinder and the cylinder pressure of the #2 cylinder is high, while FIG. 13 shows the case where combustion occurs at the #4 cylinder and the cylinder pressure of the #4 cylinder is high. In FIGS. 12 and 13, to facilitate understanding of the explanation and concepts, the block side circular cams 56 and case side circular cams 58 are omitted.

In the example shown in FIGS. 12 and 13, the relative distance sensor 43 is arranged at one side surface of the engine body 100 in the direction in which the plurality of cylinders are arranged in a row (below, referred to as "direction of cylinder array"). In particular, in the examples shown in FIGS. 12 and 13, the plurality of cylinders are arranged from the #1 cylinder to the #4 cylinder from the left side to the right side in the figure. Therefore, in the example shown in FIGS. 12 and 13, the relative distance sensor 43 is arranged adjoining the #4 cylinder.

In this regard, as shown in FIG. 12, when the cylinder pressure becomes higher due to combustion at the #2 cylinder, one of the two cylinders at the center among the four cylinders, upward force is applied to the cam shafts 54 and 55 through block side cam insertion holes 51 of the block side projections 50 arranged near the #2 cylinder. Further, the block side projections 50 arranged near the #2 cylinder are positioned at substantially the center in the direction of the cylinder array. As a result, no large moment acts on the cam shafts 54 and 55, and thus almost no force in the direction of rotation acts on the cam shafts 54 and 55 at the cross-section shown in FIG. 12. For this reason, an upward force acts entirely on the cam shafts 54 and 55, and an upward clearance is formed between the block side cam insertion holes 51 of the block side projections 50 and the cam shafts 54 and 55 (block side circular cams 56). In addition, a downward clearance is formed between the case side cam insertion holes 53 of the case side projections 52 and the cam shafts 54 and 55 (case side circular cams 58).

On the other hand, as shown in FIG. 13, when the cylinder pressure rises due to combustion at the #4 cylinder, one of the two cylinders at the sides of the four cylinders, an upward force is applied to the cam shafts 54 and 55 through the block side cam insertion holes 51 of the block side projections 50 arranged near the #4 cylinder. Further, the block side projections 50 arranged near the #4 cylinder are positioned at the end in the direction of cylinder array. As a result, moments causing upward movement at the #4 cylinder side and downward movement at the #1 cylinder side are generated at the cam shafts 54 and 55. Therefore, the cam shafts 54 and. 55 are tilted so that between the case side cam insertion holes 53 of the case side projections 52 and the cam shafts 54 and 55 (case side circular cams 58), a downward clearance is caused at the #4 cylinder side and an upward clearance is caused at the #1 cylinder side. In addition, an upward force also acts entirely on the cam shafts 54 and 55, and therefore an upward clearance is caused between the block side cam insertion holes 51 of the block side projections 50 and the cam shafts 54 and 55 (block side circular cams 56). As a result, the cylinder block 2 tilts slightly in the direction shown by the arrow X in FIG. 13 according to the tilting of the cam shafts 54 and 55.

As explained above, in the example shown in FIGS. 12 and 13, a relative distance sensor 43 is arranged at one side surface of the engine body 100. Therefore, even if the cylinder pressure rises due to combustion at the #2 cylinder, the cylinder block 2 will not tilt, and therefore the relative distance detected by the relative distance sensor 43 will not change that much. On the other hand, if the cylinder pressure becomes higher due to combustion in the 44 cylinder, the cylinder block 2 will tilt, and therefore the relative distance detected by the relative distance sensor 43 will greatly change.

<<Control in Third Embodiment>>

Figure 14:
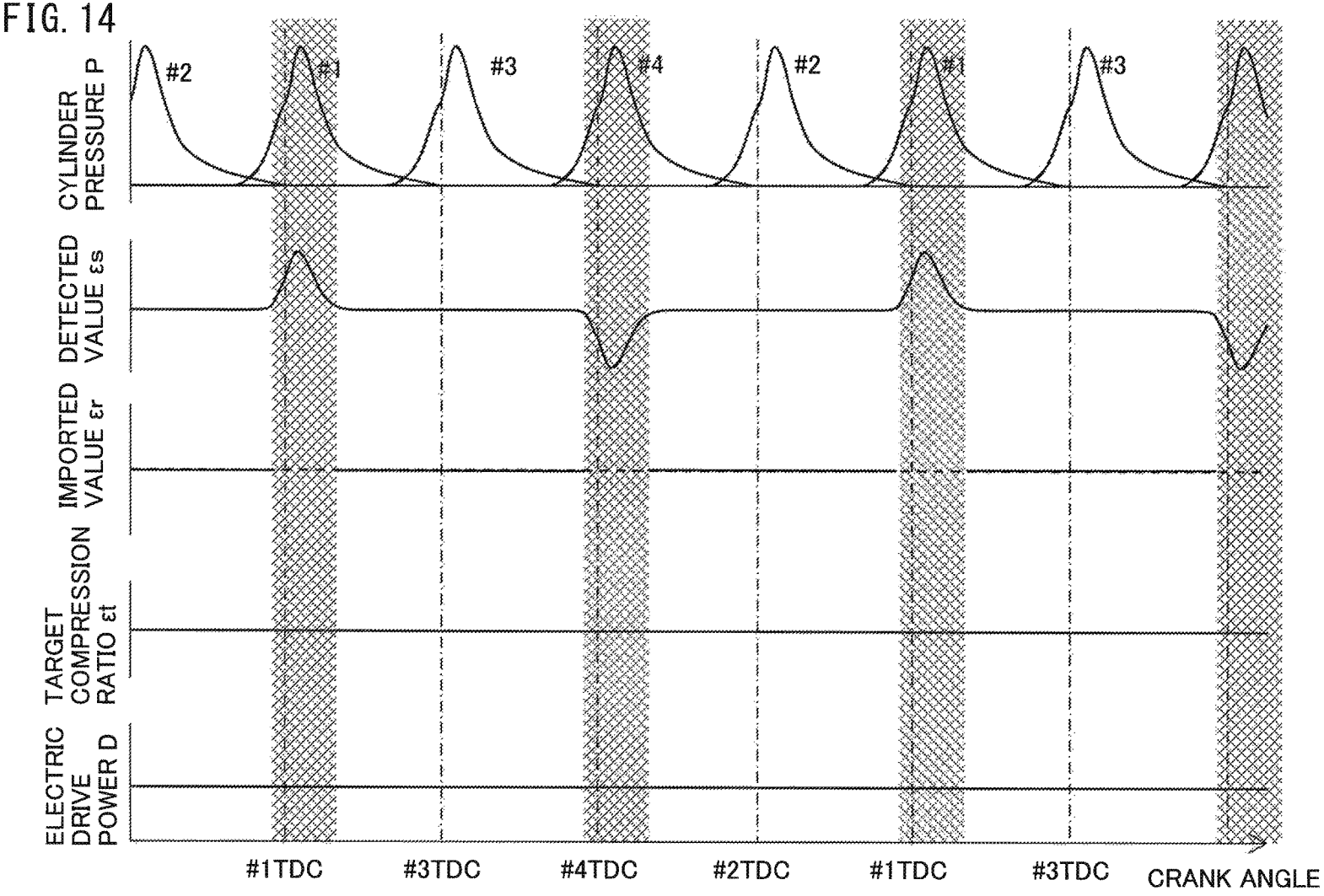
FIG. 14 is a view, similar to FIG. 6, showing transitions in a cylinder pressure, detected compression ratio value, imported compression ratio value, target mechanical compression ratio, and electric drive power, according to a crank angle.

FIG. 14 shows the transitions, similarly to FIG. 6, in the cylinder pressure 2, detected compression ratio value εs, imported compression, ratio value εr, target mechanical compression ratio εt, and the electric drive power D, according to the crank angle. In FIG. 14, the solid line of the imported compression ratio value εr shows the time when the detected compression ratio value εs is imported into the RAM 33 and the imported compression ratio value εr is updated every several milliseconds, while the broken line of the imported compression ratio value εr shows the time when the detected compression ratio value εs is not imported into the RAM 33 and therefore the imported. compression ratio value εr is not updated.

FIG. 14, as explained referring to FIGS. 12 and 13, shows the case where the cylinder block 2 is slightly tilted only when the cylinder pressure in part of the cylinders becomes higher due to combustion. As shown in FIGS. 12 and 13, if the cylinder pressure becomes higher due to combustion in the #4 cylinder, the cylinder block 2 thereby tilts and the relative distance detected by the relative distance sensor 43 becomes longer and, as a result, the detected compression ratio value εs becomes smaller. Further, if the cylinder pressure becomes higher due to combustion in the #1 cylinder, the cylinder block 2 thereby tilts in the opposite direction from the direction shown in FIGS. 12 and 13, the relative distance detected by the relative distance sensor 43 becomes shorter, and, as a result, the detected compression ratio value εs becomes larger.

On the other hand, if the cylinder pressure becomes higher due to combustion at the #2 cylinder and #3 cylinder, the cylinder block 2 will not tilt and therefore the relative distance detected by the relative distance sensor 43 will not change much at all before and after the rise in the cylinder pressure. As a result, the detected compression ratio value εs will also not change much.

Therefore, in the present embodiment, the compression ratio controller is designed so that the detected compression ratio value εs is not imported into the RAM 33 when the current crank angle is in a predetermined crank angle range, which includes a time period where the cylinder pressure is equal to or greater than a preset predetermined reference pressure at the #1 cylinder and a time period where the cylinder pressure is equal to or greater than a preset predetermined reference pressure at the #4 cylinder. In addition, when the current crank angle is outside the predetermined crank angle range, the detected compression ratio value εs is imported into the RAM 33 and the imported compression ratio value εr is updated every several milliseconds.

Specifically, in the example shown in FIG. 14, the predetermined crank angle range means the range from −20° ATDC to 50° ATDC based on compression top dead center of the #1 cylinder and the range from −20° ATDC to 50° ATDC based on compression top dead center of the #4 cylinder. Therefore, as will be understood from FIG. 14, when the crank angle is in the range of −20° ATDC to 50° ATDC based on the compression top dead center of the #1 cylinder and #4 cylinder, the detected compression ratio value εs is not imported into the RAM 33. Therefore, during these periods, the imported compression ratio value εr is maintained at the value updated to right before the crank angle becomes −20° ATDC based on compression top dead. center of the #1 cylinder and #4 cylinder.

On the other hand, when the crank angle is outside the range of −20° ATDC to 50° ATDC based on compression top dead center of the #1 cylinder and #4 cylinder, the detected compression ratio value εs is imported into the RAM 33 and, along with this, the imported compression ratio value εr is updated every time the control routine is executed by the ECU 30.

In this way, in the present embodiment, the detected compression ratio value εs is not imported while the cylinder pressure is high only for a cylinder where the detected compression ratio value εs greatly changes when the cylinder pressure becomes higher due to combustion. Conversely speaking, even when the cylinder pressure becomes higher due to combustion, for a cylinder where the detected compression ratio value εs does not greatly change, the detected compression ratio value εs is imported even while the cylinder pressure is high. Therefore, according to the present embodiment, it is possible to reliably eliminate the effects of fluctuations of the detected compression ratio value εs accompanying fluctuation of the cylinder pressure P while keeping the frequency of importing the detected compression ratio value εs to be high and accordingly possible to raise the speed of control to the target mechanical compression ratio.

Note that, in the example shown in FIG. 14, the predetermined crank angle range is a range of −20° ATDC to 50° ATDC based on compression top dead center of specific cylinders (in the example shown in FIG. 14, the #1 cylinder and #4 cylinder). However, the predetermined crank angle range is set in the same way as the modification of the first embodiment and the second embodiment. Therefore, the predetermined crank angle range maybe a range of 0° ATDC to 30° ATDC based on compression top dead center of specific cylinders or may be a range of −10° ATDC to 40° ATDC based on compression top dead center of specific cylinders.

<<Modification of Third Embodiment>>

Next, a modification of the control device of the third embodiment will be explained. In the third embodiment, the case where when the cylinder pressure becomes higher in the #1 cylinder and #4 cylinder due to combustion, the relative distance detected by the relative distance sensor 43 changes before and after the rise of the cylinder pressure, is assumed. However, the cylinder having a great effect on the detected compression ratio value changes according to the position of arrangement of the relative distance sensor 43 (in case of using angular sensor instead of relative distance sensor 43, angular sensor), the specific configuration of the engine body 100, etc.

For example, when the cylinder pressure becomes higher due to combustion at only the #1 cylinder positioned at one end in the direction of cylinder array, sometimes the detected compression ratio value εs changes before and after the rise of the cylinder pressure, while for the other cylinders, even if the cylinder pressure becomes higher due to combustion, the detected compression ratio value εs does not change before and after the rise of the cylinder pressure. In this case, the compression ratio controller is designed so that the detected compression ratio value εs is not imported into the RAM 33 when at the #1 cylinder, the current crank angle is inside a predetermined crank angle range including a time period where the cylinder pressure is equal to or greater than a preset predetermined reference pressure. In addition, when the current crank angle is outside the predetermined crank angle range, the detected compression ratio value εs is imported into the RAM 33 and the imported compression ratio value εr is updated every several milliseconds.

Therefore, the control device according to the third embodiment and its modifications can be said to be configured so that the internal combustion engine has three or more cylinders arranged in one line, the compression ratio detector is arranged adjacent to a cylinder positioned at one end in a direction in which the plurality of cylinders are arranged in a row, and the predetermined crank angle range includes a time period when the cylinder pressure is equal to or greater than a preset predetermined pressure at the cylinder positioned at the end.

Further, in the third embodiment, when the crank angle is outside the predetermined crank angle range, in the ECU 30, the detected compression ratio value εs is imported into the RAM 33 and the imported compression ratio value εr is updated every several milliseconds. However, in the same way as the first embodiment and its modification, in the ECU 30, the detected compression ratio value εs may be imported into the RAM 33 and the imported compression ratio value εr updated when the crank angle is at a detection crank angle set outside the predetermined crank angle range.

<<Explanation of Control Using Flow Chart>>

Next, referring to FIG. 15, specific control of the variable compression ratio mechanism A according to the present embodiment will be explained. The feedback control of the variable compression ratio mechanism A comprises a control routine similar to the control routine shown in. FIG. 7 in the present embodiment as well. Further, the compression ratio importing control for importing the detected compression ratio value to the RAM 33 may be performed by a control routine similar to the control routine shown in FIG. 11 in the present embodiment as well.

Figure 15:
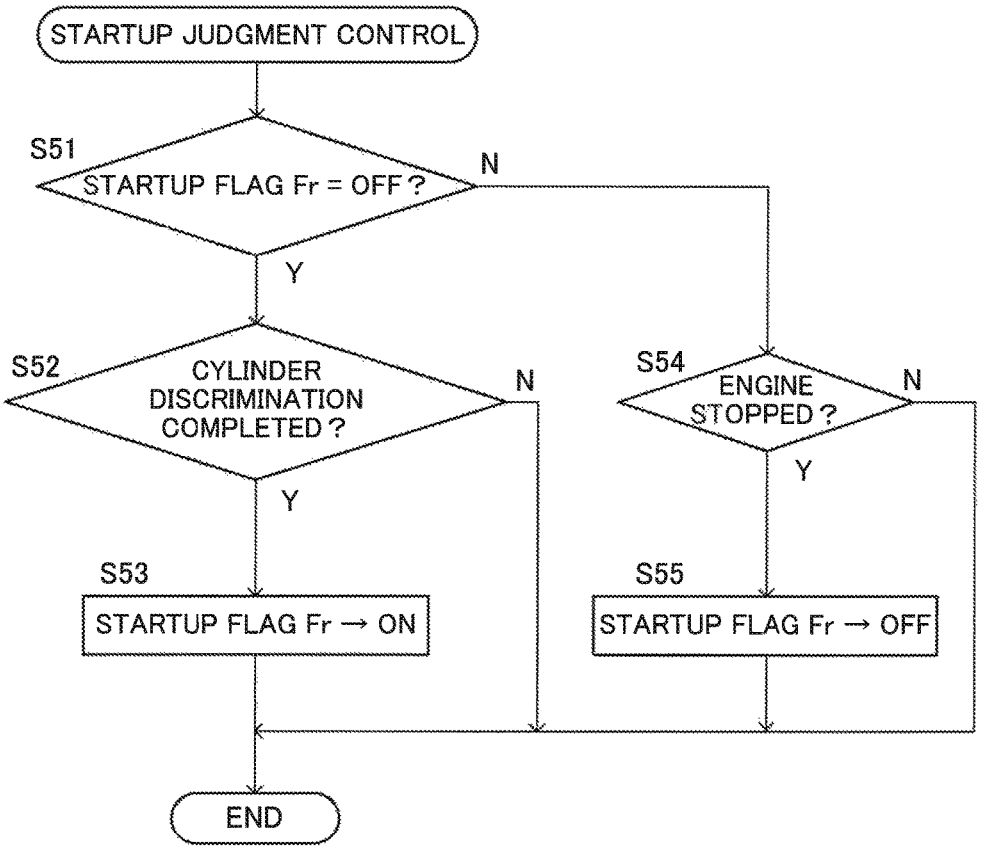
FIG. 15 is a flow chart, similar to FIG. 9, showing a control routine of startup judgment control for judging startup of an internal combustion engine.

FIG. 15 is a flow chart showing the control routine of startup judgment control for judging startup of the internal combustion engine. The illustrated control routine is executed at constant time intervals (for example, 4 ms).

As shown in FIG. 15, first, at step S51, it is judged if currently the startup flag Fr is set to OFF. If it is judged that the startup flag Fr has been set to OFF, the routine proceeds to step S52. At step S52, it is judged if a cylinder has finished being discriminated. The cylinder is discriminated by judging whether the current crankshaft turns once or turns twice in one cycle since one cycle is completed when the crankshaft turns twice. By performing such cylinder discrimination, it becomes possible to detect the crank angle based on compression top dead center for a specific cylinder. When it is judged that the cylinder discrimination has not. been completed, the startup flag Fr is left OFF as it is and the control routine is ended.

On the other hand, when it is judged at step S52 that the cylinder discrimination has been completed, the routine proceeds to step S53. At step S53, the startup flag Fr is set to ON and the control routine is ended.

Further, when at step S51 it is judged that the currently the startup flag Fr is set ON, the routine proceeds to step S54. At step S54, it is judged if the internal combustion engine has stopped. When at step S54 it is judged that the internal combustion engine has not stopped, the startup flag Fr is left set. ON and the control routine is ended. On the other hand, when at step S54 it is judged that the internal combustion engine has stopped, the routine proceeds to step S55. At step S55, the startup flag Fr is set to OFF and the control routine is ended.

<Summary of All Embodiments>

If summarizing the first embodiment to the third embodiment explained above, the compression ratio controller can be said to feedback control the variable compression ratio mechanism A without using a mechanical compression ratio detected by a compression ratio detector when, in at least one cylinder where the fluctuation of the relative position parameter is the greatest due to fluctuation of the cylinder pressure accompanying combustion, a crank angle is in a predetermined crank angle range including a time period where the cylinder pressure is equal to or greater than a preset predetermined pressure. In addition, the predetermined crank angle range is preferably a range of 0° ATDC to 30° ATDC based on compression top dead center at least at one cylinder.

REFERENCE SIGNS LIST

1. crankcase
2. cylinder block
3. cylinder head.
6. spark plug
13. fuel injector
30. electronic control unit (ECU)
43. relative distance sensor
54 and 55. cam shaft

59. drive motor
60. shaft
A. variable compression ratio mechanism
B. variable valve timing mechanism

The invention claimed is:

1. A control device of an internal combustion engine controlling an internal combustion engine having a plurality of cylinders which comprises a variable compression ratio mechanism able to change a mechanical compression ratio by moving a cylinder block relative to a crankcase, said control device comprising:

a compression ratio detector configured to detect a mechanical compression ratio based on a value of a relative position parameter representing a relative positional relationship between the cylinder block and a piston with respect to a crank angle; and a compression ratio controller configured to feedback-control said variable compression ratio mechanism so that the mechanical compression ratio detected by said compression ratio detector becomes a target mechanical compression ratio, wherein in feedback controlling said variable compression ratio mechanism, the compression ratio controller is configured not to use the mechanical compression ratio detected by said compression ratio detector when a crank angle is in a predetermined crank angle range including a time period where a cylinder pressure is equal to or greater than a preset predetermined pressure at least at one cylinder where the fluctuation of said relative position parameter is greatest due to fluctuation of the cylinder pressure accompanying combustion.

2. The control device of an internal combustion engine according to claim 1, wherein said compression ratio detector is configured to detect a relative position of said crankcase and said cylinder block to thereby detect the mechanical compression ratio.

3. The control device of an internal combustion engine according to claim 1, wherein said predetermined crank angle range is a range of 0° ATDC to 30° ATDC based on compression top dead center of at least one cylinder.

4. The control device of an internal combustion engine according to claim 1, wherein said predetermined crank angle range includes a time period where said cylinder pressure is equal to or greater than a preset predetermined pressure at all of the cylinders.

5. The control device of an internal combustion engine according to claim 4, wherein said predetermined crank angle range is a range of 0° ATDC to 30° ATDC based on compression top dead center at each cylinder.

6. The control device of an internal combustion engine according to claim 1, wherein in feedback controlling said variable compression ratio mechanism, said compression ratio controller is configured to use only the mechanical compression ratio detected by said compression ratio detector at a specific crank angle set outside said predetermined crank angle range.

7. The control device of an internal combustion engine according to claim 6, wherein said specific crank angle is set at an every angle obtained by dividing 720° by the number of cylinders.

8. The control device of an internal combustion engine according to claim 2, wherein said internal combustion engine has three or more cylinders arranged in one line, said compression ratio detector is arranged adjacent to a cylinder positioned at one end in a direction in which said cylinders are arranged in a row, and said predetermined crank angle range includes a time period when said cylinder pressure is equal to or greater than a preset predetermined pressure at said cylinder positioned at one ends.

9. The control device of an internal combustion engine according to claim 1, wherein in feedback controlling said variable compression ratio mechanism, said compression ratio controller is configured to use a mechanical compression ratio detected at a predetermined time interval regardless of the crank angle when an engine rotational speed is less than a predetermined reference rotational speed, which is lower than an idling speed.

10. A control method for controlling an internal combustion engine having a plurality of cylinders which comprises a variable compression ratio mechanism able to change a mechanical compression ratio by moving a cylinder block relative to a crankcase, the control method comprising:

detecting a mechanical compression ratio based on a value of a relative position parameter representing a relative positional relationship between the cylinder block and a piston with respect to a crank angle; and feedback controlling said variable compression ratio mechanism so that said detected mechanical compression ratio becomes a target mechanical compression ratio; and, wherein in feedback controlling said variable compression ratio mechanism, the detected mechanical compression ratio is not used when a crank angle is in a predetermined crank angle range including a time period where said cylinder pressure is equal to or greater than a preset predetermined pressure at least at one cylinder where the fluctuation of said relative position parameter is greatest due to fluctuation of the cylinder pressure accompanying combustion.

* * * * *